US012709848B2

(12) United States Patent
Craig et al.

(10) Patent No.: US 12,709,848 B2
(45) Date of Patent: Aug. 18, 2026

(54) MATERIAL COLLECTION SYSTEMS, VEHICLES, AND RELATED METHODS

(71) Applicant: Alamo Group Inc., Seguin, TX (US)

(72) Inventors: Steven W. Craig, Big Bend, WI (US); Jason David Hetcher, Mukwonago, WI (US)

(73) Assignee: Alamo Group Inc., Seguin, TX (US)

( * ) Notice: Subject to any disclaimer, the term of this patent is extended or adjusted under 35 U.S.C. 154(b) by 532 days.

(21) Appl. No.: 18/136,782

(22) Filed: Apr. 19, 2023

(65) Prior Publication Data

US 2024/0352691 A1 Oct. 24, 2024

(51) Int. Cl.
*E01H 1/08* (2006.01)
*E01H 1/00* (2006.01)

(52) U.S. Cl.
CPC ..... *E01H 1/0827* (2013.01); *E01H 1/005* (2013.01)

(58) Field of Classification Search
CPC ..... E01H 1/005; E01H 1/0827; E01H 1/0836
See application file for complete search history.

(56) References Cited

U.S. PATENT DOCUMENTS

| | | | | |
|---|---|---|---|---|
| 3,332,664 | A | 7/1967 | Luketa | |
| 3,355,034 | A | 11/1967 | Holan | |
| 3,515,168 | A | 6/1970 | Tamny | |
| 4,160,302 | A | 7/1979 | Hirst et al. | |
| 4,578,840 | A * | 4/1986 | Pausch | E01H 1/0836 15/340.1 |
| 4,899,986 | A | 2/1990 | Tweedy | |
| 4,922,571 | A * | 5/1990 | Driear | E03F 7/106 15/340.1 |
| 5,050,265 | A | 9/1991 | Stout et al. | |
| 5,380,121 | A | 1/1995 | Schluter | |
| 5,577,772 | A | 11/1996 | Kaiser | |
| 6,283,162 | B1 | 9/2001 | Butler | |
| 6,478,340 | B1 | 11/2002 | Butler | |
| 6,789,291 | B2 | 9/2004 | Velinsky et al. | |
| 11,131,070 | B2 | 9/2021 | Baez et al. | |
| 11,142,886 | B2 | 10/2021 | Renger et al. | |
| 11,448,192 | B2 | 9/2022 | Bartminn et al. | |
| 2005/0166350 | A1 | 8/2005 | Buckner | |
| 2011/0244163 | A1 | 10/2011 | Keough | |
| 2020/0309304 | A1 | 10/2020 | Gevik | |
| 2020/0391648 | A1 | 12/2020 | Malmassari et al. | |
| 2022/0056665 | A1* | 2/2022 | Mayer | E02F 3/8825 |
| 2022/0145583 | A1* | 5/2022 | Mayer | E02F 3/8825 |

FOREIGN PATENT DOCUMENTS

| | | | |
|---|---|---|---|
| CA | 2882352 | A1 | 11/2015 |
| CN | 201704788 | U | 1/2011 |
| CN | 210151907 | U | 3/2020 |

(Continued)

*Primary Examiner* — Matthew R Buck
(74) *Attorney, Agent, or Firm* — Pizarro Allen PC

(57) ABSTRACT

A material collection vehicle may include a vehicle body and a mounting system including a turret sealingly coupled to a boom mounting joint. The mounting system may be used for mounting a telescopic boom assembly. The boom assembly may include a bearing seal to provide for sealed fluid communication through the boom assembly. The mounting system and boom assembly may form a sealed fluid flow path from the boom assembly to the vehicle body through the mounting system.

18 Claims, 25 Drawing Sheets

(56) References Cited

FOREIGN PATENT DOCUMENTS

| | | | | |
|---|---|---|---|---|
| CN | 210636570 | U | 5/2020 | |
| CN | 210797698 | U | 6/2020 | |
| CN | 212772773 | U | 3/2021 | |
| CN | 113957835 | A | 1/2022 | |
| CN | 217204585 | U | 8/2022 | |
| EP | 2363214 | A1 | 9/2011 | |
| EP | 1302435 | B1 | 3/2018 | |
| EP | 3515249 | B1 | 7/2020 | |
| JP | 1997084893 | | 3/1997 | |
| JP | 2002212969 | | 7/2002 | |
| JP | 2017048574 | | 3/2017 | |
| KR | 100779448 | | 11/2007 | |
| KR | 101048323 | B1 * | 7/2011 | ..... E01H 1/0827 |
| KR | 1018181238 | | 1/2018 | |
| KR | 102217666 | B1 | 2/2021 | |

* cited by examiner

MATERIAL COLLECTION SYSTEMS, VEHICLES, AND RELATED METHODS

CROSS REFERENCE TO RELATED APPLICATIONS

None

FIELD

This disclosure relates to material or debris collection systems including vacuum excavation vehicles which may include adjustable mounting systems for boom assemblies.

BACKGROUND

This section is intended to provide a background or context to the invention that is recited in the claims. The description herein may include concepts that could be pursued but are not necessarily ones that have been previously conceived or pursued. Therefore, unless otherwise indicated herein, what is described in this section is not prior art to the description and claims in this application and is not admitted to be prior art by inclusion in this section.

Material or debris collection systems and vehicles may commonly include a suction hose that may be supported by an adjustable mounting system so that the hose may be positioned as needed for debris collection at a work site. For example, such systems and vehicles may be configured as described in U.S. Pat. No. 5,577,772. These systems and vehicles may, for example, be used for sewer cleaning, storm drain cleaning, excavation, hydro excavation, leaf or litter collection, or for other suitable purposes. Some material collection systems or vehicles, e.g., vacuum excavators, may include a source of pressurized fluid or a lance configured to break up material or debris prior to its collection. Accordingly, collected material may commonly include residual fluid mixed with other materials present at a work site. More generally, the material collected by a material collection system or vehicle may include a heterogenous mixture of solid, liquid, and hardened particulate matter. Such compositions provide challenges when designing cost effective systems for their collection.

In some instances, collection systems including flexible and flexibly extendable hosing or tubing have commonly been used to provide for sealed collection of these compositions. This hosing or tubing may commonly be part of an adjustable boom assembly. Such a boom assembly may, for example, include a hose and one or more telescopically extendable support members. The hose may, for example, be secured to the one or more telescopically extendable support members using one or more straps, mounts, or brackets. Accordingly, movement or extension of the support members may be translated to movement of the hose. The hose may, for example, be flexibly extendable in length so that telescopic extension of the support members may result in corresponding extension of the hose. More generally, adjustable boom assemblies may commonly be configured to be rotated, pivoted, or extended to position hosing or tubing towards a desired position for material or debris collection.

Although hosing and telescopically extendable support members may be secured together along a boom assembly, the hosing and support members may be separate structures (e.g., the hosing is secured to but is not part of the support members) so that the two structures are separately mounted to the body of a vehicle. In some configurations, hosing may, over at least some sections of a boom, be positioned inside of or received through telescopically extendable support members. In those configurations, as collected material is drawn inwards through hosing towards the vehicle body for collection, it is generally routed though flexibly extending tubing or hosing (e.g., a bellows tube) bypassing the joints connecting the support members to their mounts. In other words, collected material may be routed around or past mounting joints for the telescopic support members and through relatively expensive flexibly extending tubing to an entry port of the vehicle for eventual collection in a vehicle collection tank. In the aforementioned configurations, there is no driving reason to seal any of the attachment joints by which the support members are coupled to the vehicle body because fluid does not contact them.

Unfortunately, the hosing or tubing used to bypass such attachment joints may be particularly subject to wear during use. For example, hosing may, in some configurations, be forced to flex, turn, or bend as the hosing is adjustably positioned during material or debris collection. Accordingly, suction-propelled material may sometimes be routed through one or more turns or bends formed in the hosing so that particulate material entrained therein must change direction in passing therethrough. In this geometry, particulate material may frequently be driven into the walls of the hosing to impact thereupon and increase wear on the hosing so that it may need to be replaced with some frequency thereby increasing maintenance effort and cost. More generally, suction-propelled compositions may inherently wear out the hosing or tubing used for their collection.

Accordingly, there is a need for improved systems for material collection.

SUMMARY

Systems described herein may be directed towards solving the aforementioned problems or other problems. For example, in some embodiments, a knuckle joint may be sealed so that material may be passed directly through and not around the joint. Accordingly, relatively expensive flexibly extendable tubing or hosing commonly used in other systems may be fully avoided or minimized. In some embodiments, a telescopic boom assembly may be modified (e.g., using bearing seals and/or specially configured pipe sections as described herein) so that material may be passed directly through a boom assembly without requiring any wear-prone hosing or tubing or only using a minimum amount of such hosing or tubing (e.g., in portions of the boom assembly wherein the stream of materials has little or no change in direction). In some embodiments, a telescopic boom assembly may be constructed to securely support an extension and/or retraction actuator and substantially isolate the actuator from strain induced from torsional or bending loads placed upon the boom assembly. This may not only help to improve actuator performance and lifetime but may also allow booms of considerable length to be operated using only a single extension and/or retraction actuator. In some embodiments, one or more sensitive components of actuators may further be protected at least in part within a knuckle joint housing to further reduce risk of damage to those components.

In some embodiments, a material collection vehicle may include a telescopically extendable boom assembly and a mounting system for connecting the boom assembly to a body of the material collection vehicle. The boom assembly may include a plurality of boom sections including a first boom section, a second boom section, and a bearing seal. The bearing seal may be coupled between the first boom section and the second boom section. The first boom section and the second boom section may be sealingly coupled together by the bearing seal to provide a sealing engagement between the first boom section and the second boom section and to allow for telescopic extension of the second boom section from the first boom section without disrupting the sealing engagement between the first boom section and the second boom section. The mounting assembly may include a turret and a knuckle joint, the knuckle joint being sealingly coupled to the turret. For example, the knuckle joint may be sealingly coupled to the turret at a sealed interface between the knuckle joint and a turret housing so that intermediate flexible hosing or tubing may not be required between the knuckle joint and the turret housing.

In some embodiments, a mounting system (58) configured for mounting a boom assembly (20, 300, 502) to a material collection vehicle (10) may include a rotatable turret (24), including a turret housing (100) enclosing a turret chamber (102), and a knuckle joint (22). The knuckle joint (22) may include a knuckle joint housing (44) shaped to form an opening (136) providing for fluid communication through the knuckle joint housing along a fluid pathway including the turret chamber, the knuckle joint being sealingly coupled to the turret using one or more seal packings (150, 152, 154, 156), the one or more seal packings forming a seal along a boundary between the knuckle joint and the turret. The seal may maintain sealing engagement between the turret and the knuckle joint over a range of motion of the knuckle joint.

In some embodiments, a boom assembly for a material collection vehicle (10) may include a first boom section (32), a second boom section (34), and a bearing seal (346). The bearing seal (346) may couple the first boom section with the second boom section. The first boom section and the second boom section form an internal channel and are sealingly coupled together by the bearing seal to provide a sealing engagement between the first boom section and the second boom section and to allow for telescopic extension of the second boom section with respect to the first boom section without disrupting the sealing engagement between the first boom section and the second boom section.

In some embodiments, a material collection vehicle (10) may include a telescopically extendable boom assembly (20) and a mounting system (58) configured for connecting the boom assembly to the material collection vehicle. The telescopically extendable boom assembly may include a first boom section (32), a second boom section (34), and a bearing seal (346). The bearing seal (346) may couple the first boom section and the second boom section. The first boom section and the second boom section are sealingly coupled together by the bearing seal to provide a sealing engagement between the first boom section and the second boom section and to allow for telescopic extension of the second boom section with respect to the first boom section while maintaining the sealing engagement between said first boom section and said second boom section. The mounting system (58) may include a turret (24) including a turret housing (100); and a knuckle joint (22) including a knuckle joint housing (44), the knuckle joint being sealingly coupled to the turret.

In some embodiments, a mounting system (500) configured for mounting a boom assembly (20, 300, 502) to a material collection vehicle (10) may include a turret (24) including a turret housing (100) enclosing a turret chamber (102), and a joint (22, 522). The joint (22, 522) may include a joint housing (44, 526) shaped to form an opening (136, 527) providing for fluid communication along a fluid pathway including the turret chamber. The joint (22, 522) may be sealingly coupled to the turret using one or more seal packings (150, 152, 154, 156, 540), the one or more seal packings forming a seal along a boundary between the joint and the turret. The seal maintains sealing engagement between the turret and the joint over a range of motion of the joint.

In some embodiments, a material collection vehicle may include a telescopically extendable boom assembly and a mounting system configured connecting the boom assembly to a body of the material collection vehicle. The extendable boom assembly may include a first boom section and a second boom section, the second boom section being configured for nested engagement with said first boom section. The mounting system may include a joint including a joint housing shaped to form an opening disposed along a sealed path of fluid communication extending from an interior portion of the boom assembly to the vehicle body through the joint.

In some embodiments, a method of making a boom section for a boom assembly may include, shaping of an upper half pipe section (68) of a first boom section; shaping of a lower half pipe section (70) of the first boom section; forming alignment holes in each of the upper half pipe section and the lower half pipe section; positioning of rods and spacers in the alignment holes to maintain a proper width between the two half pipes during welding; welding the upper half pipe section to the lower half pipe section; removing the rods and the spacers from the alignment holes; and plug welding of said alignment holes.

BRIEF DESCRIPTION OF THE DRAWINGS

In FIG. 3, the vehicle is shown with the boom assembly rotated to a position towards the right side of the vehicle.

In FIG. 5, the boom assembly is shown in a partially extended configuration.

In FIG. 8, a right-side wall of the turret has been omitted from view so that an interior chamber of the turret and flow path of collected material therethrough is shown.

In FIG. 11, some components (e.g., seal packings, retaining structures for the seal packings, and a bearing for the knuckle or pivot pin) otherwise connected to the turret housing in use are shown exploded therefrom.

In FIG. 12, a left-side wall of the turret and front edge thereof is shown with a compression band and underlying seal packing mounted thereto.

In FIG. 13, the front edge of the left-side wall of the turret is shown from a different viewpoint than in FIG. 12 and without the seal packing and the associated compression band mounted thereto.

DETAILED DESCRIPTION

Figure 1:
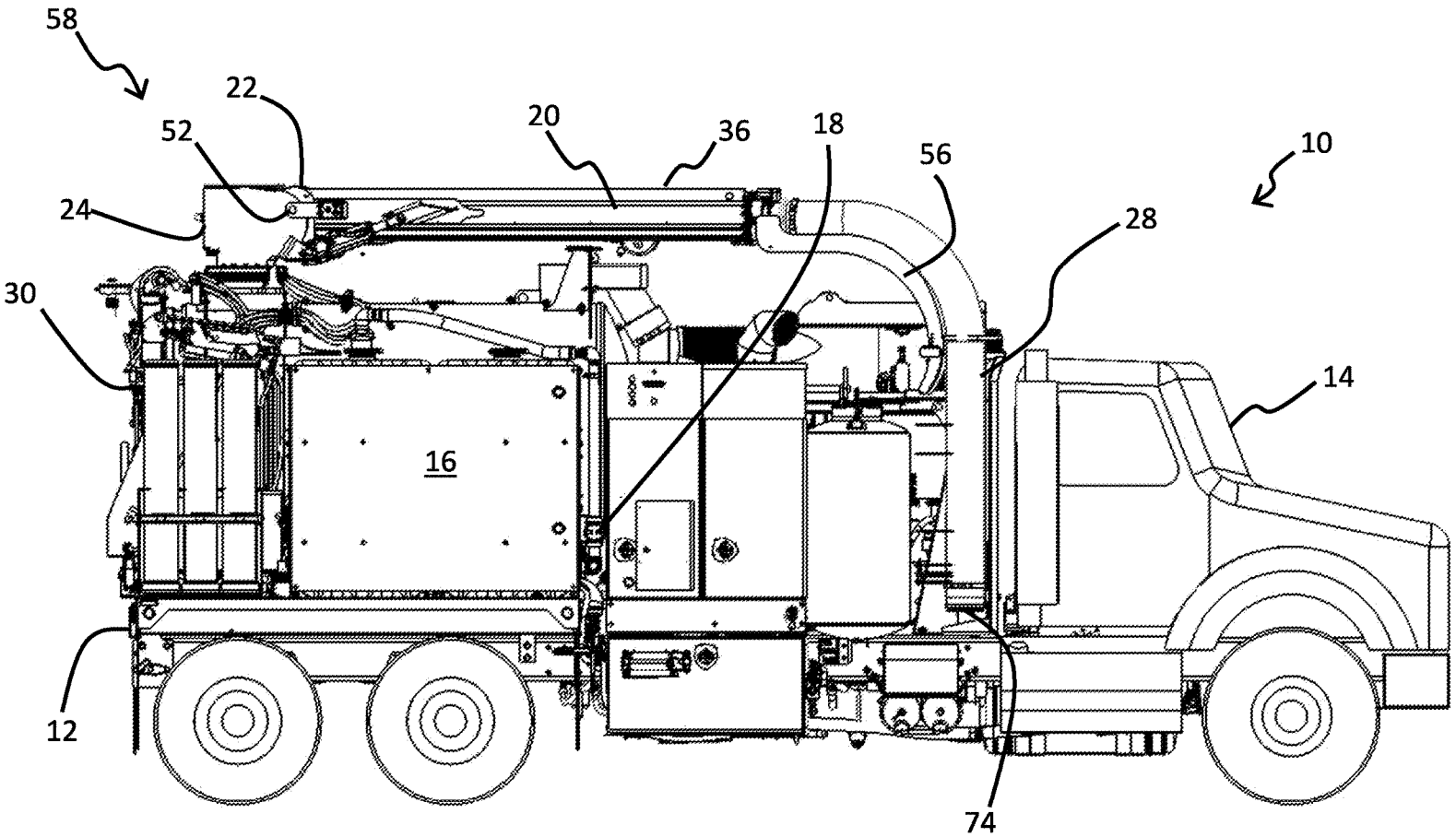
FIG. 1 is a right-side elevation view of an exemplary embodiment of a material collection vehicle including an adjustable boom assembly.

As used herein, the following terms should be understood to have the indicated meanings:

When an item is introduced by "a" or "an," it should be understood to mean one or more of that item.

A "ball-and-socket joint" as used herein refers to a joint including a generally ball-shaped housing which is spherical or spheroidal along at least a portion of its exterior shape. The housing may be mounted to one end of a boom assembly and fit into a complementary shaped socket to allow for pivoting movement of the boom assembly about at least two axes centered on the joint. A ball-shaped housing which is spherical or spheroidal along at least a portion of its exterior shape does not preclude deviations in shape of the housing (e.g., truncations or the presence of openings useful for material communication or other features as may be used to connect the housing to other structures including boom sections or support structures) that do not materially affect the movement of the joint about the at least two axes.

Accordingly, a boom assembly mounted to a ball-and-socket joint may rotate about at least two axes (e.g., upwards or downwards in a first or vertical plane and side-to-side in a second or horizontal plane). In some embodiments, a ball-and-socket joint may include a generally ball-shaped housing which is spherical along at least a portion of its exterior shape and mounted on one end of a boom assembly and fit into a complementary shaped socket so that the joint housing may rotate substantially freely within the socket (e.g., over a substantially conical range of motion). In such embodiments of a ball-and-socket joint, the boom assembly may pivot about any number of axes centered on the joint. In other embodiments, pivoting motion may be restricted in some directions. For example, a ball-and-socket joint may include a joint housing which is shaped as an imperfect sphere (e.g., a spheroid) along at least a portion of its exterior and mounted on one end of a boom assembly. This joint housing may again be received in a complementary shaped socket. The relative shape of the joint housing and the socket may allow the boom assembly to pivot about each of a first axis and a second axis, both axes being centered on the joint, but not other axes. Pivoting movement about the first axis may facilitate movement of the boom assembly upwards and downwards, for example, whereas pivoting movement about the second axis may facilitate movement of the boom assembly in a side-to-side direction, but movement in other directions may be prevented or limited. Of course, other orientations of boom movement may also be done.

"Comprises" means includes but is not limited to.

"Comprising" means including but not limited to.

The term "extension length" as used herein in reference to a telescopic boom assembly refers to a difference in length between a first measured length of the boom assembly in its fully retracted configuration and a second measured length of the boom assembly in an extended configuration. A "maximum extension length" refers to the difference in length between a first measured length of the boom assembly in its fully retracted configuration and a second measured length of the boom assembly in its fully extended configuration.

"Having" means including but not limited to.

The terms "proximal" and "distal" may be used herein to denote proximity of a component to the body of a vehicle. For example, the proximal end of a boom assembly, a section of a boom assembly, an actuator mounted to a boom assembly, or a conduit or other structure connected to the boom assembly refers to the end of the component that is positioned closest to the vehicle body when the boom assembly is mounted thereto. The distal end refers to the end of the component that is further from the vehicle body when the boom assembly is mounted thereto.

This disclosure is directed to boom assemblies, adjustable mounting systems for boom assemblies, joints and bearing seals for boom assemblies, material collection systems or vehicles comprising boom assemblies, and related system components and methods of manufacture. The vehicles and other systems described herein may, for example, be configured for sewer cleaning, storm drain cleaning, excavation, hydro excavation, leaf or litter collection, or for other suitable purposes. Of course, vehicles or other systems specialized for different purposes may sometimes include some different components and be configured somewhat differently yet still embody one or more of the inventive features described herein.

In some embodiments, material collection vehicles as described herein may include a telescopic boom assembly including one or more sealed conduits comprising a telescopic support system. A sealed conduit comprising a telescopic support system may be part of a conduit system including an inlet at its distal end. The inlet may be positioned so that material or debris may be vacuum collected therethrough using suction. To position or aid in positioning an inlet, a telescopic boom assembly may be connected to the body of a vehicle using an adjustable mounting system. Using an adjustable mounting system, a boom assembly may, for example, be swung to either side of a vehicle to help position the boom assembly as appropriate for material or debris collection. An adjustable mounting system may include a joint (e.g., a knuckle joint or ball-and-socket joint) configured to allow the boom assembly to move relative to the body of a vehicle to help position a material collection inlet or an attachment connected thereto in relation to material or debris.

In some embodiments, an adjustable mounting system may be configured for mounting a boom assembly to a vehicle body and may include a sealed joint coupled to or part of a turret or a rotatable turret, for example. The joint may be sealed so that material or debris may be drawn therethrough during routing of collected material for removal or storage, such as storage in a collection tank of a vehicle, for example. Advantageously, in some of those embodiments, collected material may pass directly through the joint without being routed through separate hosing or tubing (e.g., a bellows tubing) which may otherwise be used to divert collected material around rather than through the joint. Notably, this hosing or tubing used in some systems may sometimes direct collected material through at least one bend or turn while routing collected material past the joint. In those configurations, collected material may be particularly driven to impinge upon the walls of the hosing or tubing so that the hosing or tubing may be subject to significant wear in use such that it may need to be routinely replaced. In that light, those embodiments herein of systems configured to remove a need for this hosing or tubing may provide improved reliability, reduce downtime, and remove a significant source of maintenance and upkeep cost.

In some embodiments, an adjustable mounting system may be part of a sealed path of fluid communication extending from a material collection inlet to a collection tank of a vehicle. The adjustable mounting system may include one or more sealed joints and may be configured to support, at least in part, a boom assembly with one or more conduits integrated therein in a cantilevered configuration. For example, a joint may include a housing confining the pathway of fluid or debris collection and preventing or minimizing leakage of fluid therethrough. In some embodiments, a joint housing may provide a surface upon which a seal packing is sealingly engaged. The seal packing may further be mounted to a turret, for example. Thus, in some embodiments, a seal packing may be disposed directly between a turret housing and a joint housing. This seal packing may be disposed so that it may slide or move along at least one surface of the joint housing but still maintain sealing engagement between the two housings. Accordingly, in some embodiments, a seal packing may be sealingly and slidably engaged to a joint housing. In some embodiments, a joint may be a sealed knuckle joint and include a knuckle pin, the joint being configured for allowing pivoting movement of the boom assembly about the knuckle pin.

Notably, in some embodiments, the joints described herein may be sealed yet still be configured to withstand significant tensile, torsional, or bending loads that may be experienced when used in a mount supporting a boom assembly held in a cantilevered configuration. For example, a knuckle joint may help to minimize strain and deformation that may risk compromising seals engaged therein and which may tend to initiate seal failure. In some embodiments, boom assemblies as described herein may be configured to minimize the effects of tensile, torsional, or bending type loads placed on one or more joints used in a mounting system for the boom assembly. For example, in some embodiments, joints (e.g., knuckle joints or ball-and-socket joints) may be sealed and mounted to a boom assembly including one or more anti-rotation or stabilization bars, anti-rotation wear pads, or other features to help isolate the joints from tensile, torsional, or bending loads placed on the boom assembly. In some embodiments, the seals described herein (shown in FIGS. 10, 11, and 29, for example) may have at least some level of resilience. Accordingly, the seals may be resistant to failure when positioned at an interface that is subject to at least some amount of mechanical deformation and/or stress. For example, in some embodiments, a joint may be sealed using a resilient packing material. This packing material, may, for example, be held in place using a compression band or using some other suitable mounting structure. In some embodiments, a joint may be sealed using a packing material that is held in place using a resilient compression band. Thus, in some embodiments herein, seal resilience may be afforded by the packing material itself or using a combination of a resilient packing material and a resilient seal compression band.

In some embodiments, an adjustable mounting system may be coupled to a telescopic boom assembly using one or more actuators. For example, one or more linear actuators may be used to drive telescopic extension and retraction of the boom assembly. In this specification, an actuator configured to drive telescopic extension and/or retraction of a boom assembly may sometimes be referred to as a telescopic extension and/or retraction actuator or simply a telescopic actuator. One or more other actuators may, for example, be used to drive pivoting motion of the boom assembly upwards or downwards, or side to side, or a combination thereof relative to the vehicle body or to control other types of movements of a boom. Combinations of different types of actuators, may, for example, be useful in some embodiments of systems including telerobotic arm assemblies and comprising one or more sealed joints and/or mounting systems described herein.

In some embodiments, one or more telescopic extension and/or retraction actuators or other actuators of the adjustable mounting systems described herein may, by way of nonlimiting example, be powered hydraulically, electrically, pneumatically, or with some other suitable source of power.

For example, a telescopic extension and/or retraction actuator may be a hydraulic actuator and may include a hydraulic cylinder configured to maintain or receive hydraulic pressure used to drive extension and/or retraction of an extendable and retractable piston. In some embodiments, an actuator may be powered in extension using one of the aforementioned power sources, but retraction of the piston may be driven mechanically, using a spring, for example. Thus, for example, actuators used in some embodiments herein may extend when power is provided and automatically retract in the absence or deactivation of a supplied hydraulic or other suitable power source.

In some embodiments, one end of a telescopic extension and/or retraction actuator may be positioned adjacent to or within a knuckle or ball-joint housing. For example, a connecting pin or one or more other structures of a hydraulic cylinder may be tucked within a housing of the joint. Thus, advantageously, at least a portion of the hydraulic cylinder may be protected within this housing. In some embodiments, an end cap of a hydraulic cylinder may be fully or at least in part tucked within a knuckle or ball-joint joint housing. Some embodiments herein may further accommodate ease of maintenance, installation, and removal of the cylinder. For example, one end of a hydraulic cylinder of an actuator may be protected by a knuckle or ball-joint housing, but the cylinder may be mounted in a way that still allows a user to readily access, adjust, install, or remove the actuator or the actuator's end cap. For example, one end of a hydraulic cylinder of an actuator may be mounted to a bracket and protected by a knuckle or ball-joint housing, but a user may loosen or remove one or more fasteners to disengage the bracket from a joint housing without having to remove the housing itself.

Figure 2:
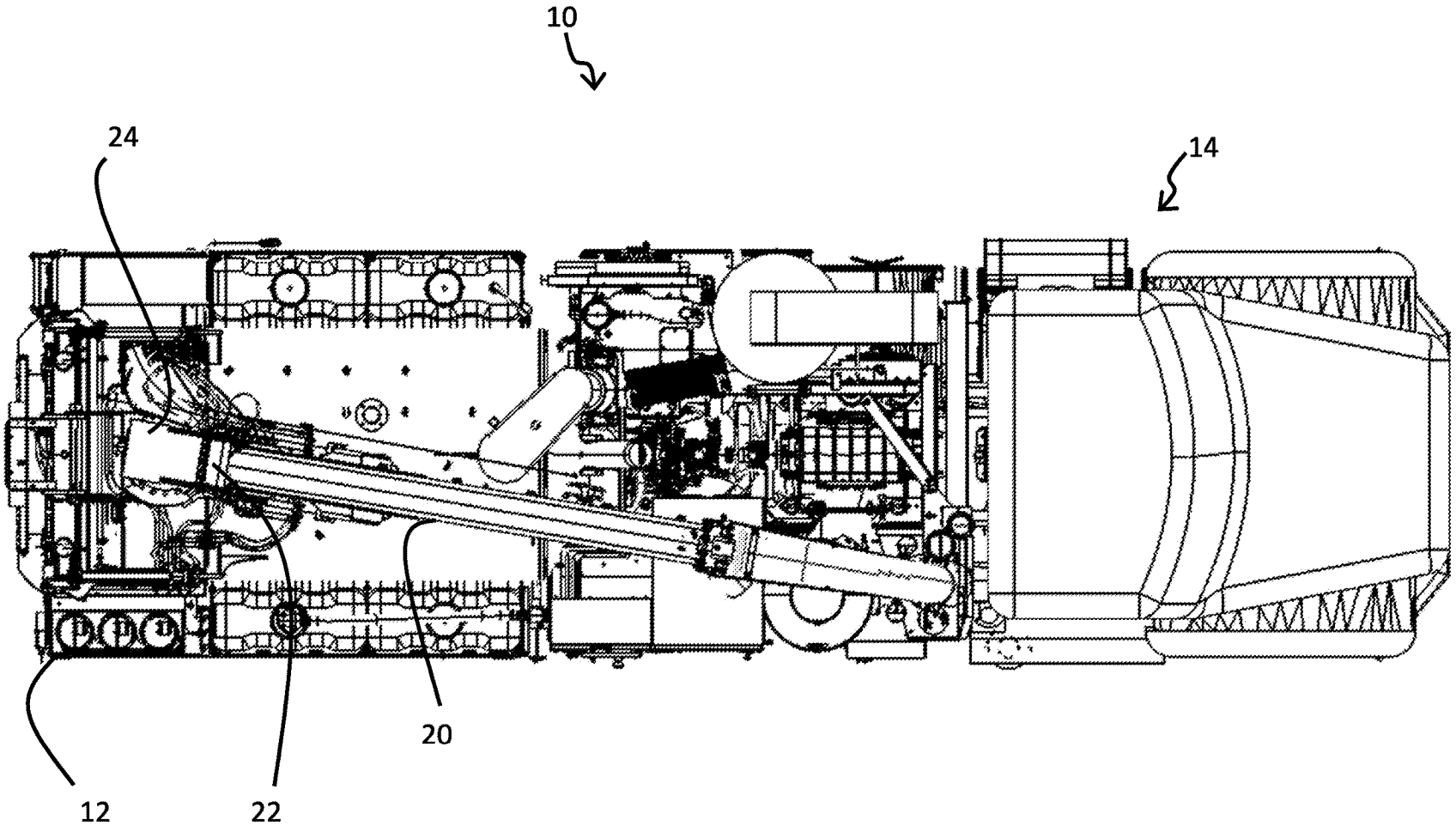
FIG. 2 is a top plan view of the material collection vehicle shown in FIG. 1.
Figure 3:
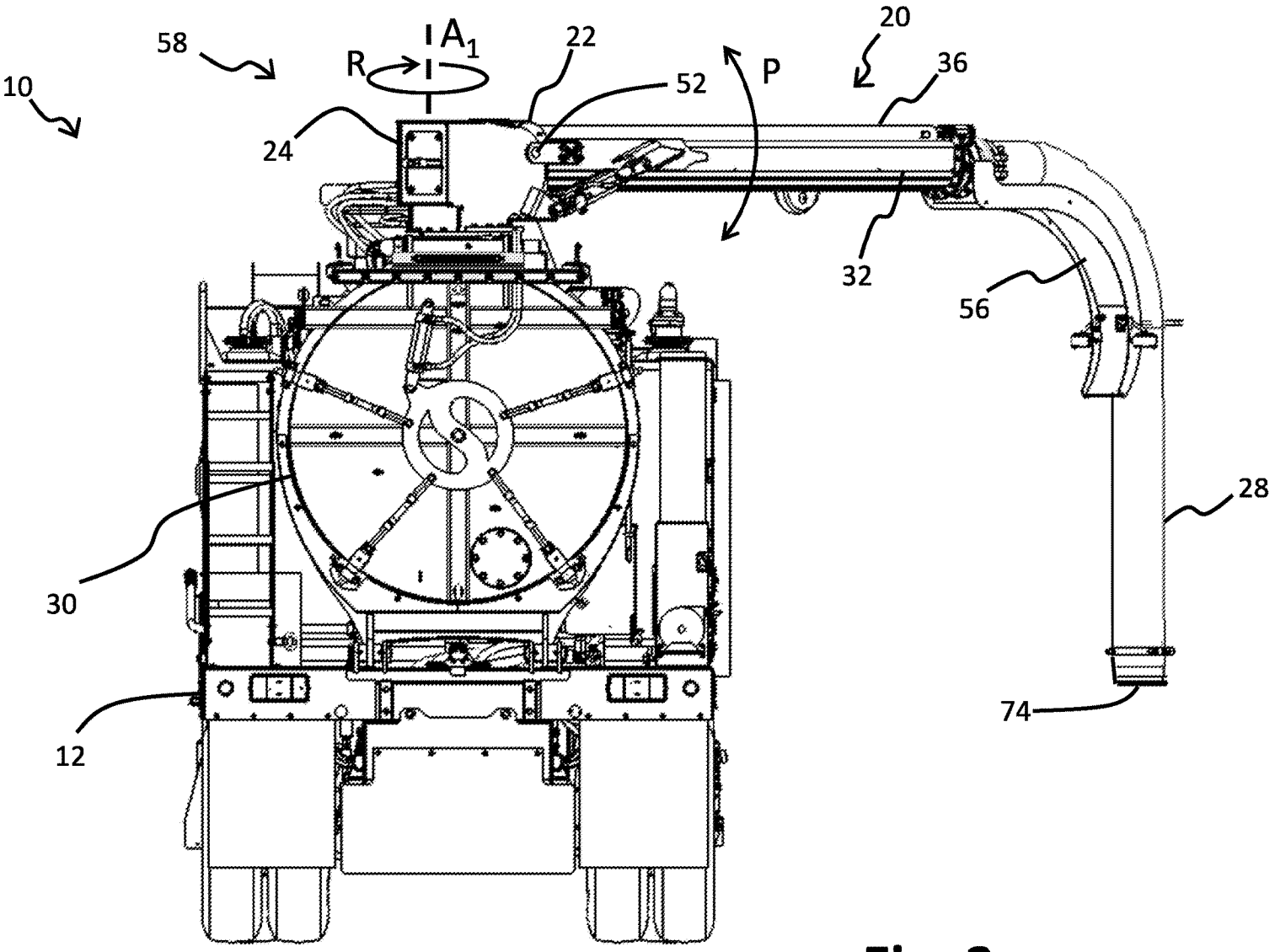
FIG. 3 is a rear elevation view of the material collection vehicle shown in FIG. 1.

An exemplary embodiment of a material collection vehicle 10 is shown in FIGS. 1-3. In some embodiments, material collection vehicle 10 may be a vacuum excavation vehicle. The vehicle 10 may include a vehicle body 12 and a cab 14. A fluid supply tank 16 and a pump system 18 may be included in the vehicle body 12. The fluid supply tank 16 and pump system 18 may be used to supply pressurized fluid useful for breaking up material or debris prior to its collection. In some embodiments, other vehicle components or systems may be used to condition a pressurized fluid. For example, in some embodiments, material collection vehicle 10 may include a heating element and an associated control panel or set of controls. A heating element may, for example, be included on an excavation vehicle configured for use in cold weather, wherein a heated fluid may be useful to assist in breaking up ice or other solid materials. In some embodiments, material collection vehicle 10 may be configured to supply compressed air as an alternative to or in addition to a pressurized liquid. For example, in some embodiments, material collection vehicle 10 may include an air compression system so that compressed air may be used to help break up material prior to its collection.

Figure 26:
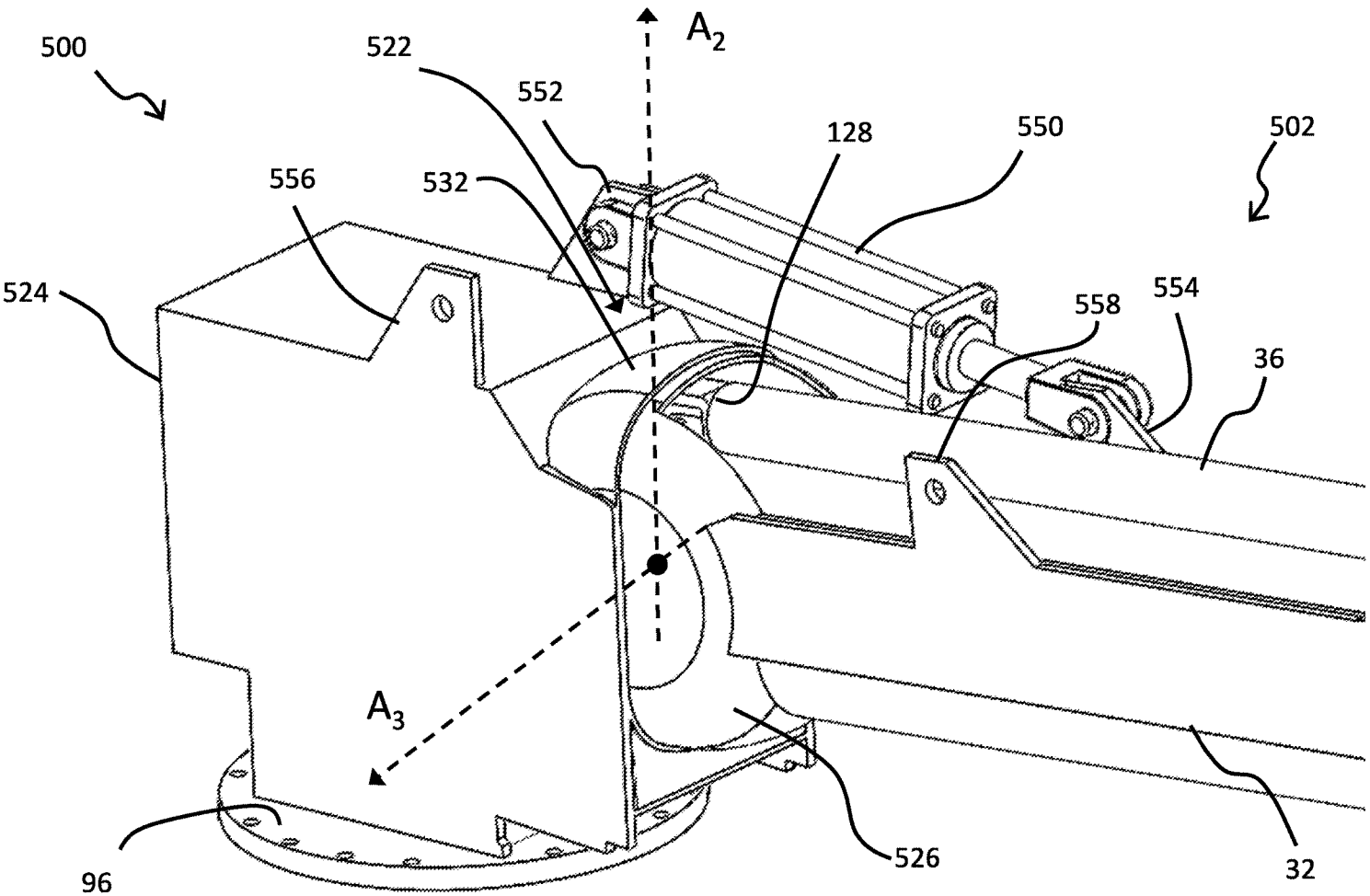
FIG. 26 is a perspective view of another embodiment of a mounting system for a boom assembly.

Material collection vehicle 10 may include a telescopic boom assembly 20. Boom assembly 20 may be coupled to the vehicle body 12 using an adjustable mounting system 58. In some embodiments, the adjustable mounting system 58 includes a knuckle joint 22 and a turret 24, such as a rotatable turret, for example. Alternatively, an adjustable mounting system 500 (as shown in FIG. 26, for example) may include a ball-and-socket joint 522. Boom assembly 20 may be coupled to the vehicle body 12 using either of the joints 22, 522, for example. The boom assembly 20 may, for example, rotate with the turret 24 so that it may be positioned as preferred during material or debris collection or to assist in moving the boom assembly between a working and a stowed or transport position. The boom assembly 20 may be pivotably mounted using knuckle joint 22 which allows for pivoting motion of the boom assembly about one or more pivot or knuckle pins 52, 53 (see also FIG. 14). For example, as shown in FIG. 3, the boom assembly 20 may be swung towards the right side (or left side) of the vehicle 10 by rotation (R) of the turret 24 about the rotation axis ($A_1$). The boom assembly 20 may also pivot (P) about the knuckle pins 52, 53 to angle the boom assembly upwards or downwards to assist in positioning a distal end conduit 28 and an associated inlet 74 for material or debris collection. Material or debris may, for example, be suctioned inwards through the inlet 74 of the distal end conduit 28, directed through a conduit system 26 (shown in FIG. 5, for example) and then through the knuckle joint 22 and turret 24 (see FIG. 8) to the vehicle body 12 for eventual expulsion, destruction, or routing to a collection tank 30.

Figure 4:
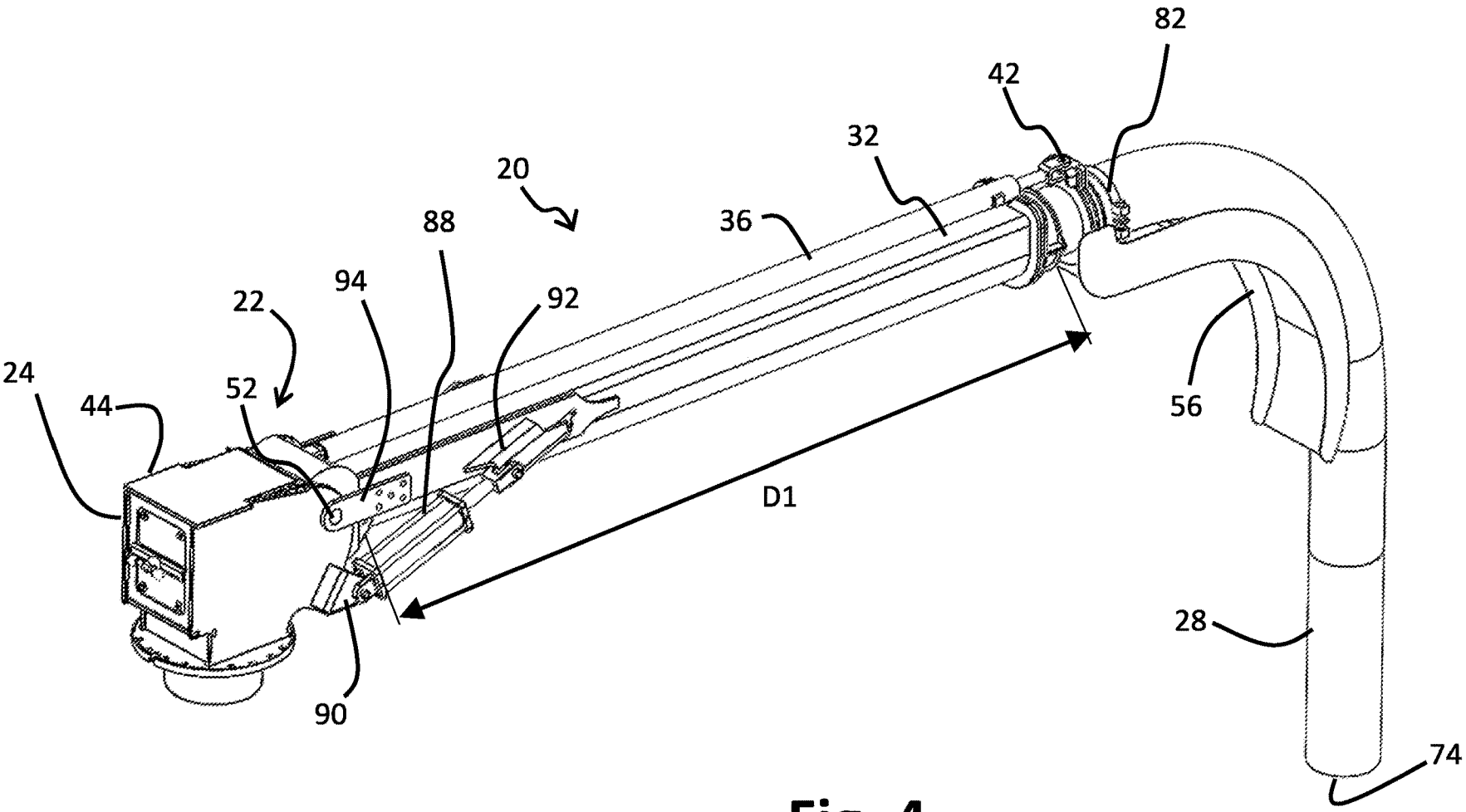
FIG. 4 is a perspective view of one embodiment of a boom assembly in a retracted configuration and connected to a turret.
Figure 5:
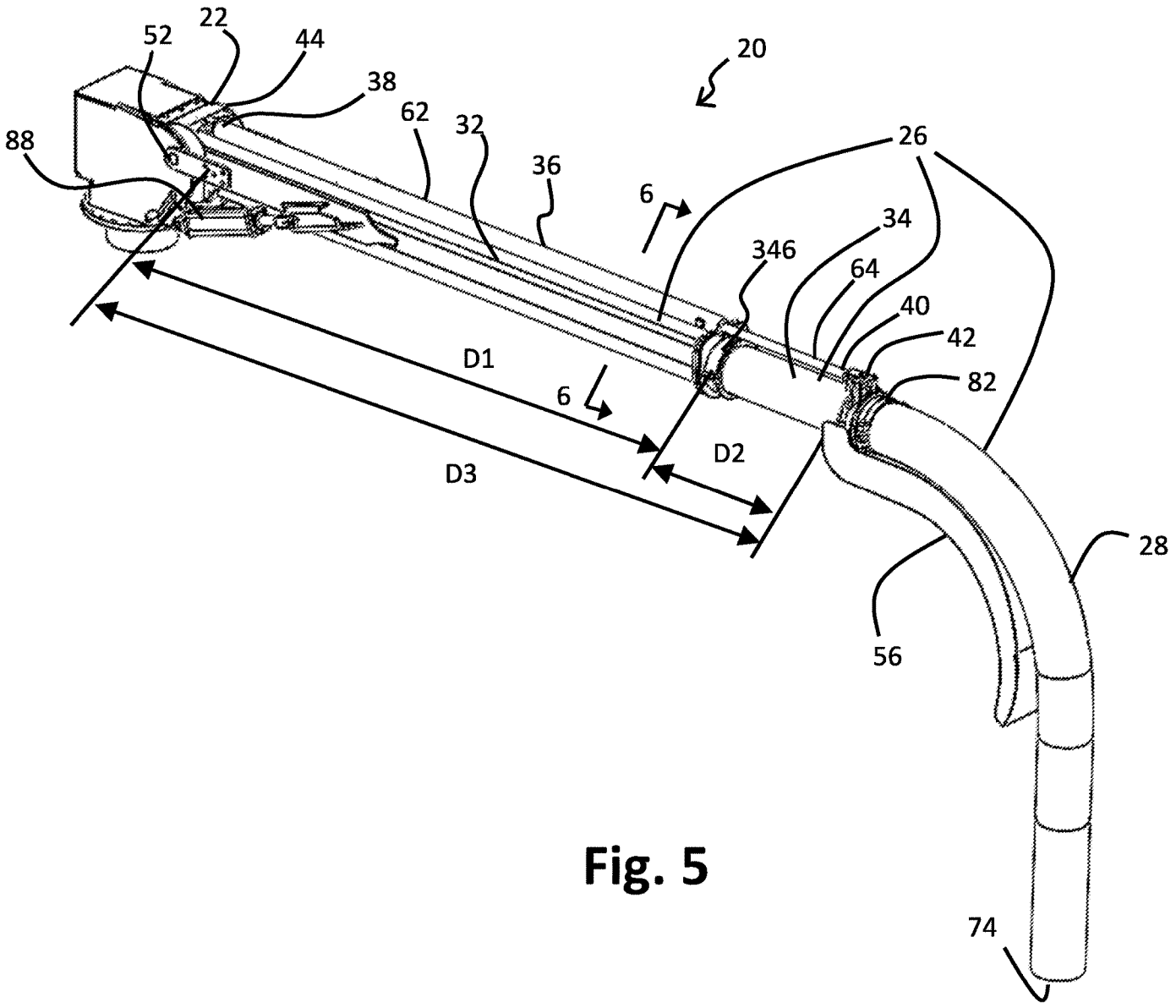
FIG. 5 is another perspective view of the boom assembly and turret shown in FIG. 4.

An embodiment of boom assembly 20 is shown in FIG. 4 and FIG. 5. FIG. 4 shows a perspective view of the boom assembly 20 in a retracted configuration and connected to the turret 24. FIG. 5 shows a perspective view of the boom assembly 20 in a partially extended configuration and connected to the turret 24. The boom assembly 20 may include a plurality of boom sections nested together. For example, viewing FIG. 4 and FIG. 5 together, a first boom section 32 may be configured to slidably receive a second boom section 34 so that the second boom section is nested or tucked within the first boom section and so obscured from view when the boom assembly 20 is in the retracted position shown in FIG. 4. The boom assembly 20 may telescopically extend outwards so that a portion of the second boom section 34 is visible in the partially extended configuration shown in FIG. 5.

Figure 6:
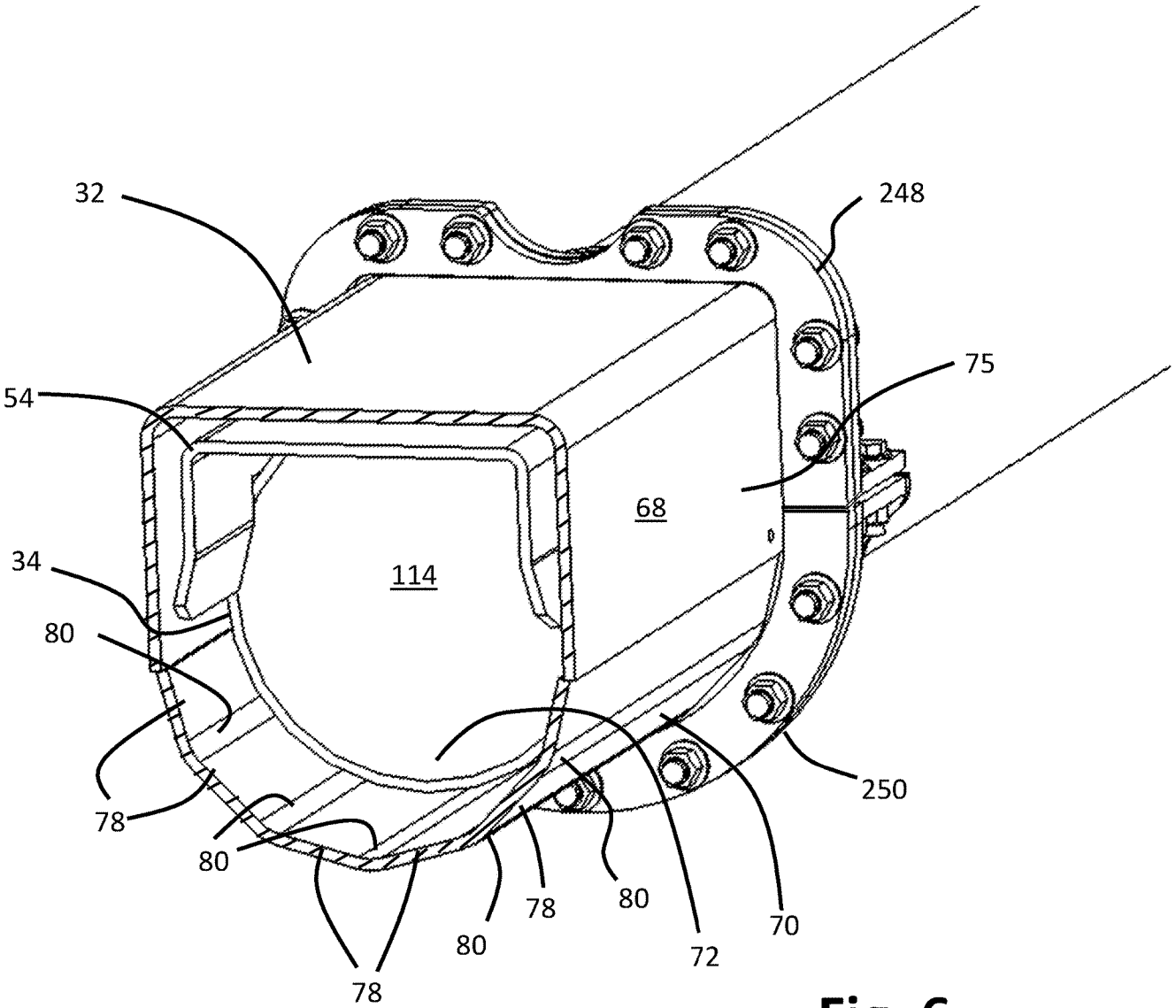
FIG. 6 is a cross-sectional perspective view of a portion of the boom assembly shown in FIG. 4 and FIG. 5 taken at section 6-6 shown in FIG. 5.

Nested engagement between the first boom section 32 and the second boom section 34 is further shown in FIG. 6. FIG. 6 shows a cross section of a portion of the boom assembly 20 in a configuration wherein the second boom section 34 is nested at least in part within the first boom section 32. The cross-section shown in FIG. 6 is taken at a plane at a position along the boom assembly 20 wherein both the first boom section 32 and the second boom section 34 are visible when looking through a material collection channel 114 formed within the boom assembly 20 (see section 6-6 in FIG. 5). As shown therein, each of the first boom section 32 and the second boom section 34 is at least partially hollow so that the channel 114 may extend through each boom section. For example, when the boom assembly 20 is in a fully retracted position in which the first boom section 32 and the second boom section 34 are fully nested, collected material may flow through the channel 114, which in this configuration may generally be bounded by inner walls of the second boom section 34. However, when the two boom sections 32, 34 are in an extended configuration, collected material may flow through one portion of the channel 114 which is bounded by inner walls of the second boom section 34 and then through another portion of the channel 114 which is bounded by inner walls of the first boom section 32.

For example, as shown in FIG. 4, the channel 114 may include a length (D1) when the boom assembly 20 is in a fully retracted position. As shown in FIG. 5, the channel 114 may extend to an overall length (D3) when in the partially extended configuration shown in FIG. 5. In this configuration, the channel 114 may be bounded by inner walls of the second boom section 34 over the length of the boom assembly shown by (D2), which correlates to the length over which the second boom section 34 has unnested from the first boom section 32, plus the portion of segment D1 for which sections 32 and 34 remain nested. At a proximal end of the channel 114, the channel may be bounded by the inner walls of the first boom section 32. In other words, at the proximal end of the channel 114, over a portion of the channel 114 wherein the second boom section 34 has unnested from the first boom section 32, the channel 114 may be bounded solely by the walls of the first boom section 32. In some embodiments, the boom assembly 20 may be extended by an extension length (which correlates with the length D2 of the channel 114) of up to about 12 feet. In some embodiments, a maximum extension length for a boom assembly may be about 6 feet to about 12 feet. In some embodiments, a maximum length of the channel 114 may be about 12 feet to about 26 feet in length.

Referring to FIG. 6, in some embodiments, the first boom section 32 may include an upper half pipe 68 with a generally C-section cross-sectional profile and a lower half pipe 70 with a cross-sectional profile in the shape of a segmented arc. The two half pipes may, for example, be made of an abrasion-resistant steel. The second boom section 34 and the first boom section 32 may be complementary in shape over at least a portion of their cross-sectional profiles. For example, the second boom section 34 may include a pipe including a cross-sectional profile shaped as a segmented arc so that a bottom portion 72 of the second boom section 34 seats against the complementary shaped lower half pipe 70 of first boom section 32. For example, as shown in FIG. 6, lower half pipe 70 of the first boom section 32 includes a plurality of substantially flat segments 78 joined by a plurality of bends 80. The bottom portion 72 of the second boom section 34 may be complementary in shape to the lower half pipe 70 of the first boom section 32. For example, the bottom portion 72 of the second boom section 34 may include a corresponding number of substantially flat segments of suitable length so that it may seat on the lower half pipe 70 portion of the first boom section 32.

In some embodiments, one or more wear pads 54 may be positioned between the first boom section 32 and the second boom section 34. The one or more wear pads 54 may help to reduce friction between the two boom sections 32, 34. For example, in the embodiment shown in FIG. 6, wear pad 54 is positioned on an interior surface of the first boom section 32 (along the top side of the first boom section) and extends downwards along a portion of each side of the upper half pipe 68 portion of first boom section 32.

Notably, as shown in FIG. 6, in some embodiments, substantial rotation of one boom section relative to another is significantly limited or prevented. For example, as shown therein, the bottom portion 72 of the second boom section 34 is complementary in shape to the lower half pipe 70. However, because lower half pipe 70 and bottom portion 72 do not have perfectly circular cross-sectional profiles, they may not simply undergo free rotation with respect to each other. In some embodiments, the relative shapes of the first boom section 32 and the second boom section 34 may be used to substantially prevent rotation between the two boom sections. Accordingly, the boom assembly 20 may be specifically configured to be resistant to deformation caused by twisting type loads.

Figure 23:
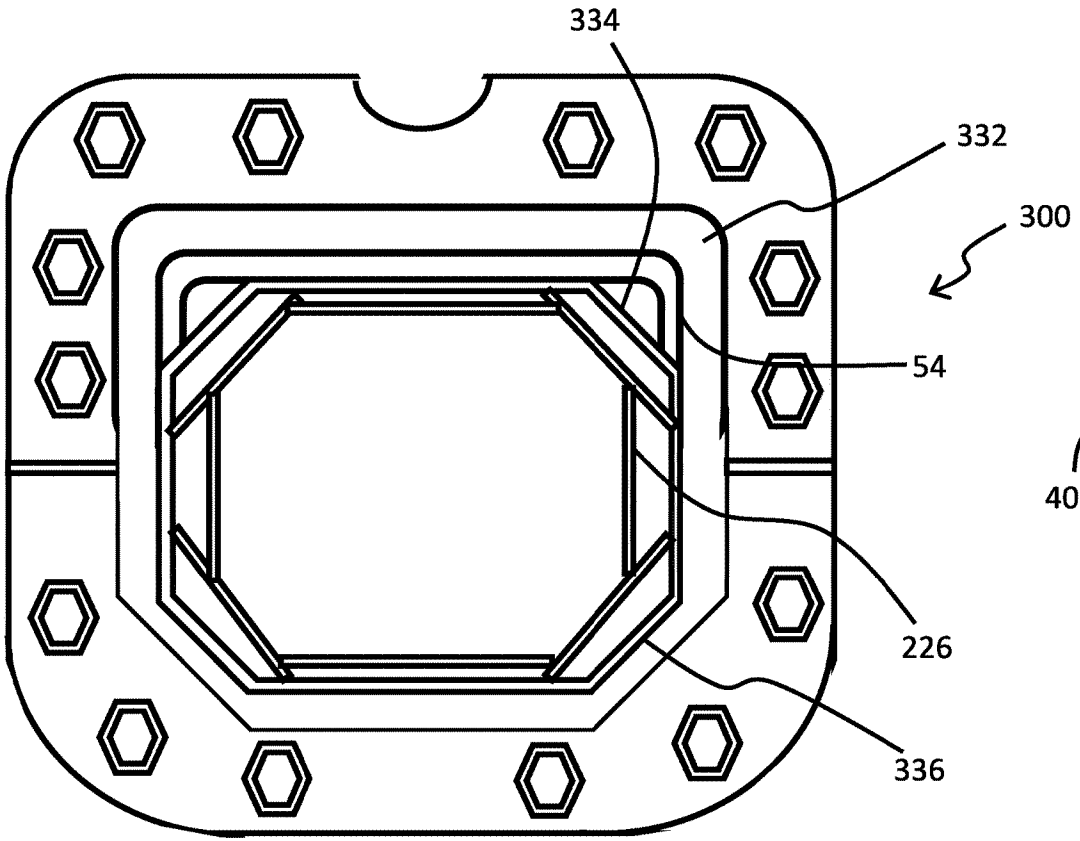
FIG. 23 is an end view of another embodiment of a boom assembly.

In some embodiments, one or more supports (e.g., columns or struts) may be used to help support the second boom section 34 and to further minimize rotation or deformation of the boom assembly 20 from twisting type loads. For example, FIG. 23 shows an end view of another embodiment of a boom assembly 300 with a second boom section 334 nested within a first boom section 332. As shown therein, the boom assembly 300 may include one or more supports 226. The boom assembly 300 may generally be similarly configured to the boom assembly 20. For example, as shown in FIG. 23, the second boom section 334 may, for example, be formed as a segmented arc. For example, second boom section 334 may include 8 straight segments 336. As shown therein, one or more supports 226 may be coupled to the inside of the second boom section 334. For example, the one or more supports 226 may be coupled to an interior facing wall of the second boom section 334 using one or more weldments, for example.

Advantageously, features described herein for reducing rotation and deformation of the boom assemblies 20, 300 in response to twisting loads may help to minimize strain on one or more actuators coupled thereto. For example, in some embodiments, the actuator 36 (shown in FIG. 5 and FIG. 7, for example) may be mounted directly on top of (or slightly spaced above) one of the first boom sections 32, 332. The first boom sections 32, 332 may be resistant to strain and deformation and supply a solid base upon which the actuator 36 may be stably mounted. Wear pads 54 or anti-rotation bars 602 (shown in FIG. 31, for example) may further be positioned to help minimize rotation of the boom assemblies 20, 300 in response to twisting types of loads. In some embodiments, a boom assembly 20, 300 may be configured for resistance to twisting type loads based on the orientation or shape of the wear pads 54, the relative cross-sectional shapes of the boom sections 32, 34, 332, 334, the presence of one or more supports 226 disposed on the interior of or coupled to the second boom sections 34, 334, the presence of one or more anti-rotation or stabilization bars 602, or using any combination of the aforementioned features.

Second boom section 34 may be connected to one or more conduits at its distal end. For example, as shown in each of FIG. 4 and FIG. 5, second boom section 34 may be connected to distal end conduit 28. Second boom section 34 may, for example, be connected to distal end conduit 28 using a mount 82, such as a hose clamp, for example. In some embodiments, distal end conduit 28 may be flexibly extendable. Accordingly, distal end conduit 28 may be at least partially received within second boom section 34, or vice versa, and may be extended outwards as it is pulled from the second boom section to position the inlet 74 in a work area, for example. In some embodiments, a support 56 (sometimes referred to as a shoe) may be used to help stabilize distal end conduit 28. Support 56 may, for example, be mounted to the second boom section 34 so that it is movable together with the second boom section 34 as the second boom section telescopically extends relative to the first boom section 32. In some embodiments, distal end conduit 28 may include flexible only and not flexibly extendable tubing. Distal end conduit 28 may, for example, include easily replaceable and relatively inexpensive flexible tubing (as compared to generally more expensive flexibly expandable tubing).

Collectively, the boom sections 32, 34 together with distal end conduit 28 may include a sealed pathway of fluid communication or conduit system 26 (shown in FIG. 5, for example) extending from the inlet 74 through the boom assembly 20. In some embodiments, material may be collected through the inlet 74 using suction, for example. Collected material may then traverse conduit system 26 and pass directly through adjustable mounting system 58 to the vehicle body 12. For example, material may pass from the boom assembly 20 through the knuckle joint 22 and into a turret chamber 102 (shown in FIG. 8). An opening or valve 76 may connect the turret chamber 102 to the vehicle body 12 so that collected material may pass from the turret to the vehicle body for routing to collection tank 30.

In some embodiments, collected material may be routed directly through telescopic boom sections 32, 34 and into the knuckle joint 22 without any intermediate flexible or flexibly extendable hosing or tubing used to sealingly couple the boom assembly 20 to the knuckle joint 22. In some embodiments, distal end conduit 28 may constitute the only flexible or flexibly extending hosing or tubing in the conduit system 26. For example, material collected at the inlet 74 may pass through distal end conduit 28 (which may include easily replaceable hosing) and into the channel 114 (which, in some embodiments, may be made of abrasion resistant steel boom sections 32, 34). The boom sections 32, 34 may accordingly, in some embodiments, be referred to as pipe sections.

One or more bearings 46 (shown in FIGS. 21 and 22, for example) may help to reduce friction between the first boom section 32 and the second boom section 34 to assist with smooth engagement or disengagement of the two boom sections. In some embodiments, as described herein in relation to FIGS. 21 and 22, for example, the one or more bearings 46 may be part of a bearing seal 346. The first boom section 32 and the second boom section 34 may be sealingly coupled together by the bearing seal 346 to provide a sealing engagement between the first boom section and the second boom section and to allow for telescopic extension of the second boom section from the first boom section without disrupting the sealing engagement.

Accordingly, in some embodiments, collected fluid material may sealingly pass directly through boom sections 32, 34 without requiring any flexible hosing or tubing received therein. Further, material may be routed directly through sealed knuckle joint 22 to turret 24 so that no other tubing or hosing (or at least external tubing or hosing positioned outside of the vehicle body) may be required in the material collection vehicle 10. Collection of material or debris and its transport from the boom assembly 20 into and along its flow path (F) through the adjustable mounting system 58 is further described below and shown in FIGS. 8 and 9, for example.

Figure 7:
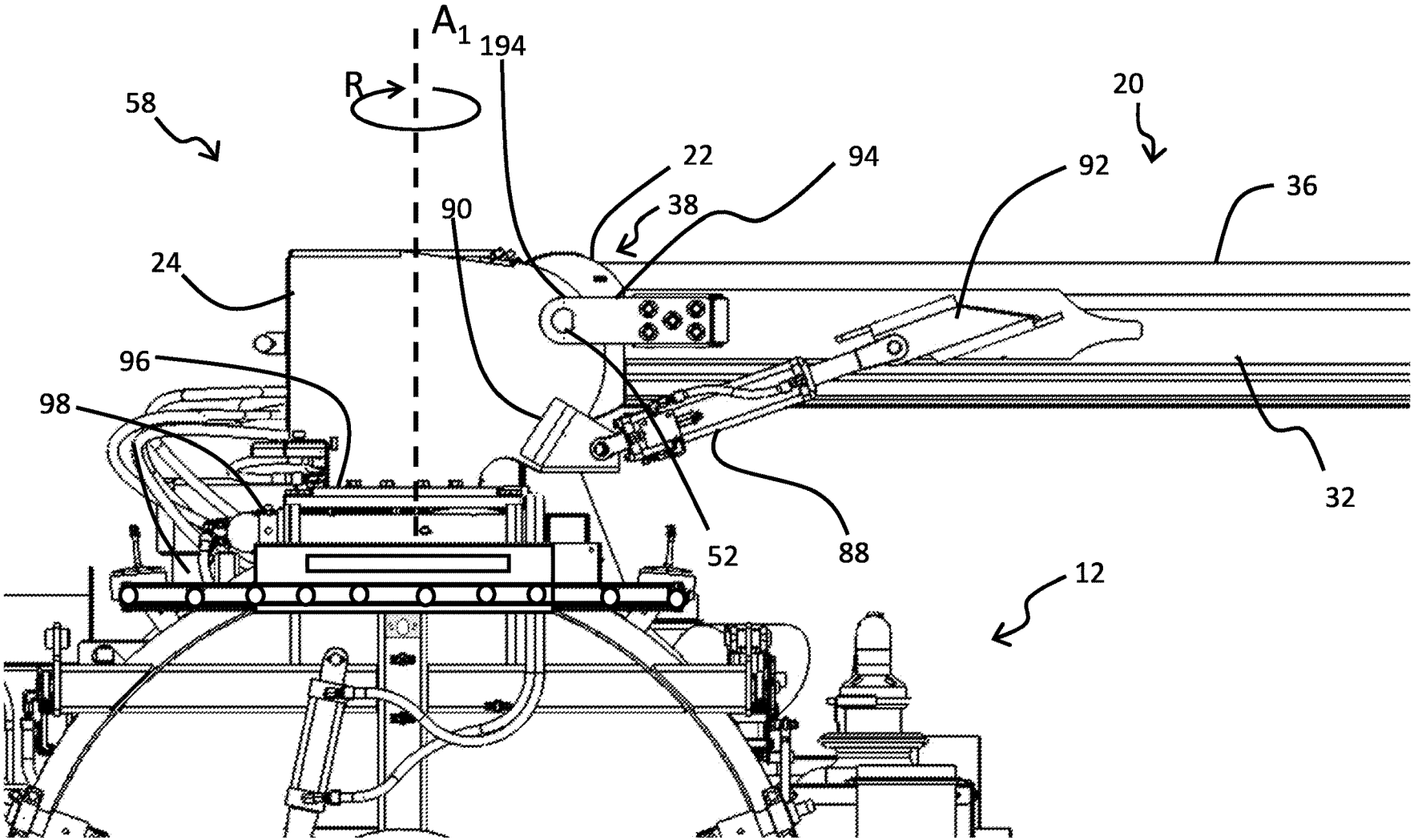
FIG. 7 is a partial rear elevational view of an embodiment of a mounting system for a boom assembly showing how the mounting system may be used to couple the boom assembly to a vehicle body.
Figure 20:
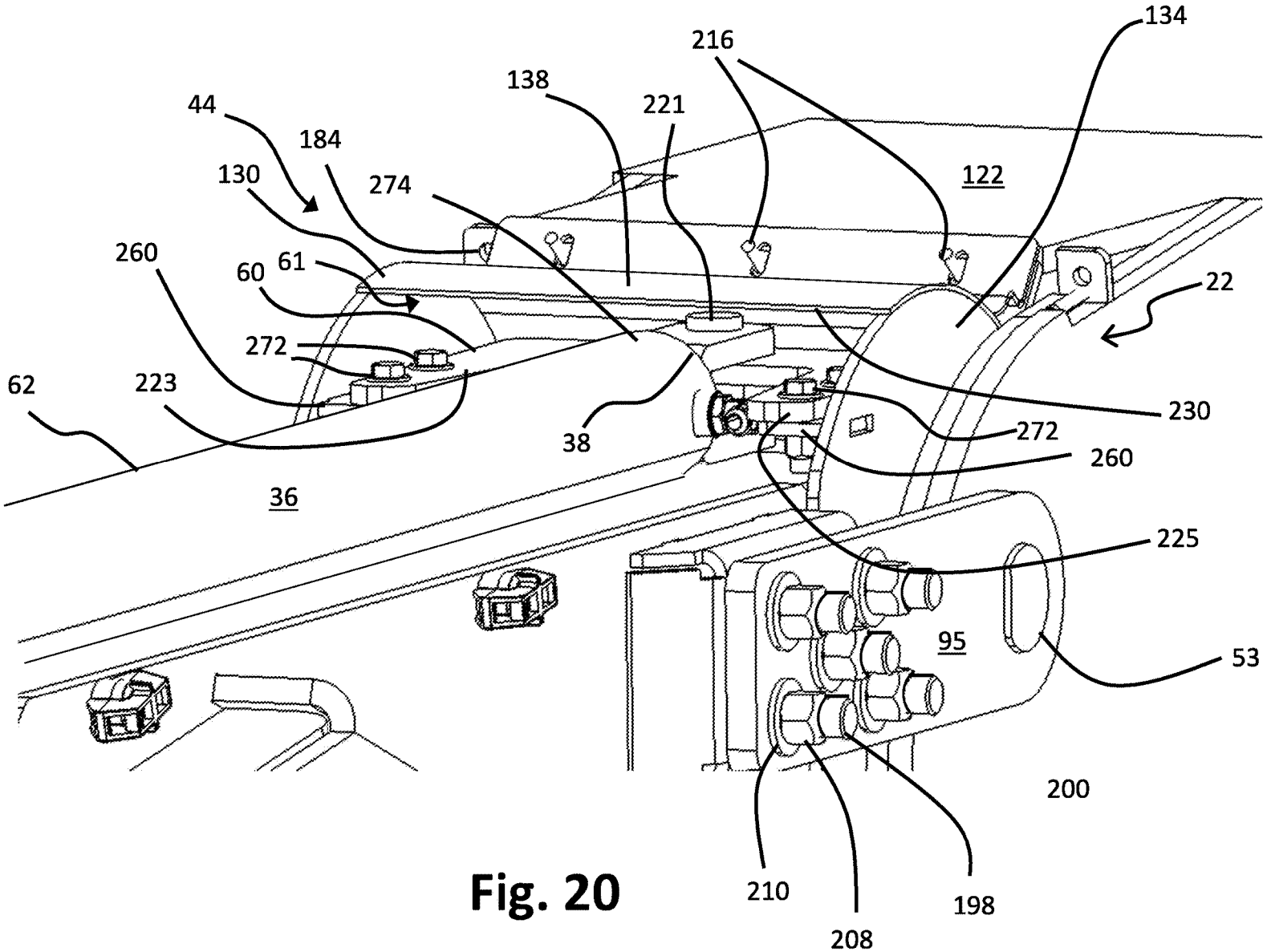
FIG. 20 is a perspective view of a knuckle joint viewed at an angle to make visible portions of an actuator tucked within the knuckle joint's housing.

FIG. 7 is a rear elevational view of an embodiment of adjustable mounting system 58 for mounting boom assembly 20 to the vehicle body 12. As shown therein, in some embodiments, adjustable mounting system 58 may include knuckle joint 22 and rotatable turret 24. Telescopic extension of the boom assembly 20 may be powered using one or more telescopic extension and/or retraction actuators. For example, in some embodiments, a single telescopic extension and/or retraction actuator 36 may be used to drive telescopic extension and retraction of the boom assembly 20. In some embodiments, as shown in FIG. 7 and FIG. 20, the proximal end 38 of actuator 36 may be disposed within a housing 44 of the knuckle joint 22. As shown in FIG. 5, the distal end 40 of actuator 36 may be connected to second boom section 34. For example, the distal end 40 of actuator 36 may be generally disposed at or near the distal end of second boom section 34 so that maximum extension and retraction of the second boom section may be achieved. Actuator 36 may, for example, be a linear hydraulic actuator including a hydraulic cylinder 62 and a piston rod 64. Hydraulic pressure may be used to extend the piston rod 64 from the hydraulic cylinder 62. Extension of the piston rod 64 may push the second boom section 34 outwards so that it slidably disengages or unnests from the first boom section 32 to a certain extent.

Figure 8:
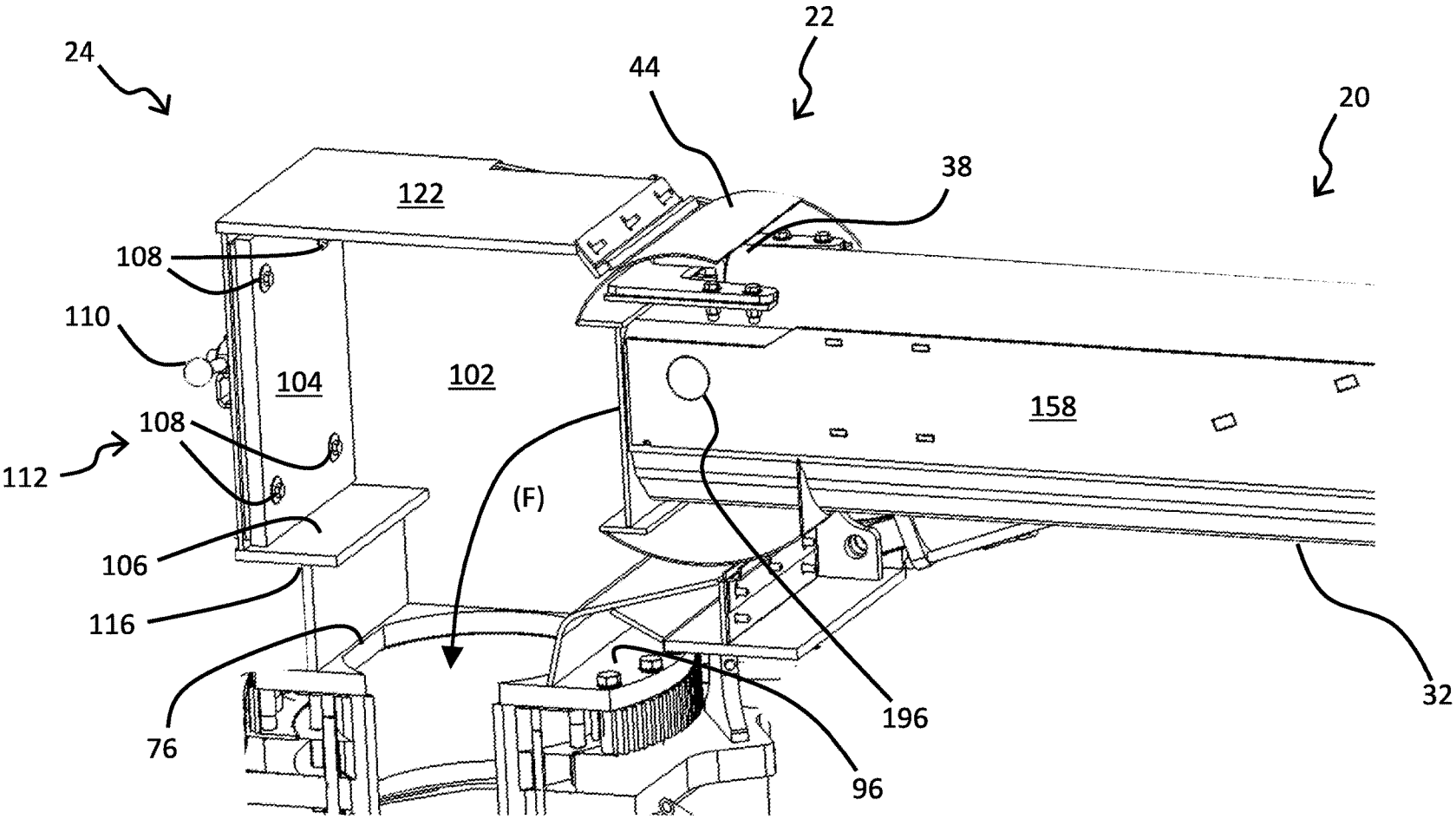
FIG. 8 is a perspective view of an embodiment of a turret and a boom assembly connected to the turret.

In some embodiments, a single actuator 36 may be mounted on top of the boom assembly 20. The proximal end 38 of actuator 36 may be tucked, at least in part, within the knuckle joint 22 (as shown in FIGS. 8 and 20, for example). In some embodiments, the proximal end 38 of actuator 36 may be connected to the first boom section 32 at a position nearby or adjacent the knuckle joint 22. For example, the proximal end 38 of the actuator 36 may be mounted on a surface of the first boom section 32 just outside of knuckle joint 22 using a suitable mount, such as a bracket and one or more pins or bolts, for example. In some embodiments, the distal end 40 of the actuator 36 (shown in FIG. 5, for example) may be connected to the second boom section 34 using a bracket 42 and one or more pins or bolts, for example.

Up and down pivoting motion of the boom assembly 20 may be powered using one or more additional actuators. For example, in some embodiments, a pair of actuators may be disposed on each side of the boom assembly 20. For example, as shown in FIG. 7, a right-side actuator 88 may be mounted with a first end of the right-side actuator 88 connected to the turret 24 using a bracket 90. A second end of the actuator 88 may be connected to the boom assembly 20 using a bracket 92. A left-side actuator may be mounted similarly to the opposite sides of the boom assembly 20 and turret 24.

Figure 9:
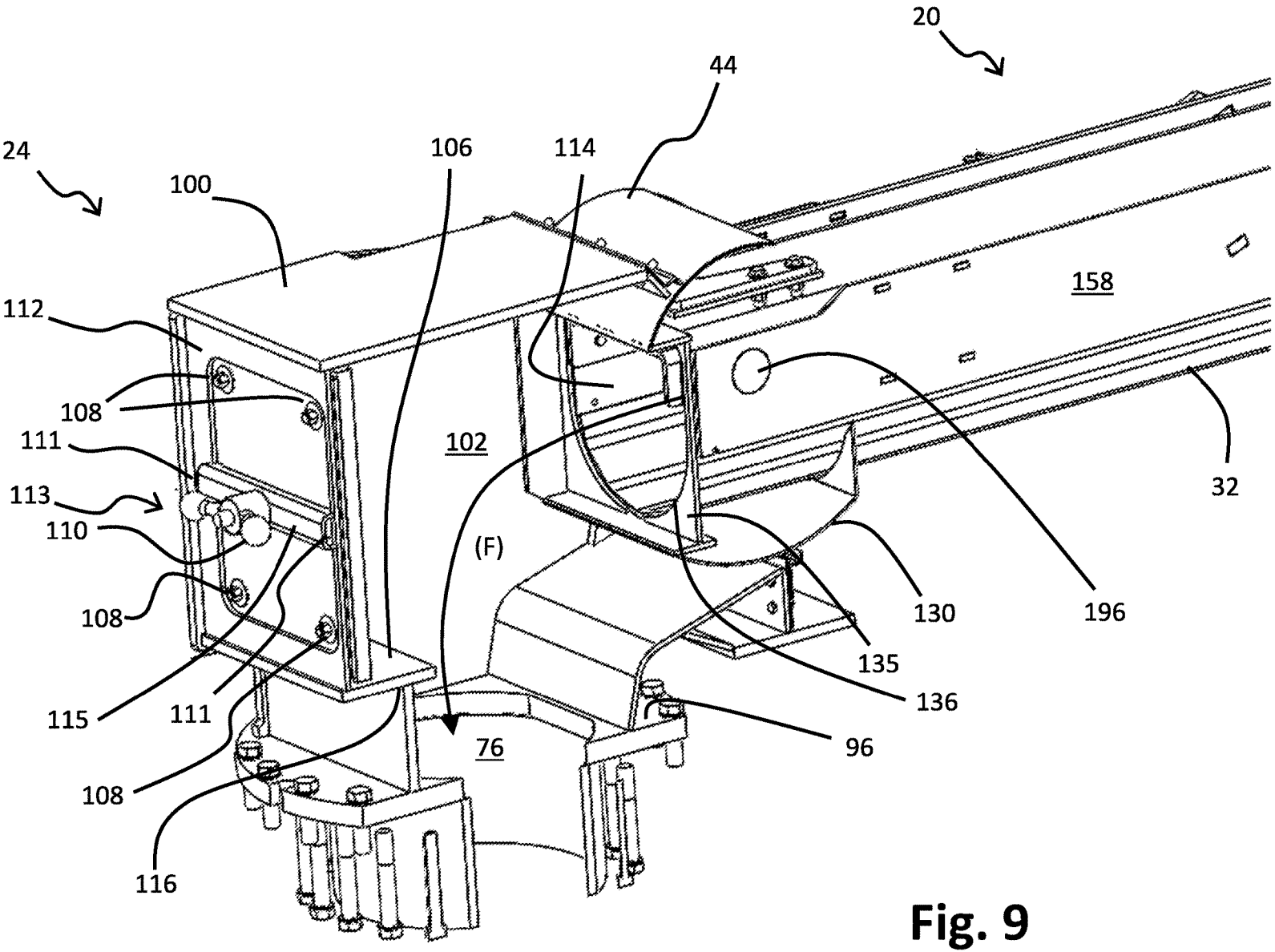
FIG. 9 is another perspective view of the turret and boom assembly shown in FIG. 8.

In some embodiments, turret 24 may be rotatably mounted to the vehicle body 12. For example, turret 24 may be mounted to the vehicle body 12 using a plate 96. Plate 96 may be coupled to the vehicle body using one or more pins, bolts or weldments, for example. For example, as shown in FIG. 7, in some embodiments, the plate 96 may be supported on one or more bearings 98 so that the turret 24 may rotate (R) about the rotation axis ($A_1$) as also described herein in relation to FIG. 3. FIG. 8 shows a perspective view of the turret 24. In FIG. 8, the near sidewall of the turret 24 has been omitted from view so that the turret chamber 102 is shown. FIG. 9 shows a similar view of the turret 24. In FIG. 9 a wall of the first boom section 32 is further omitted so that a more complete view of the flow path (F) of collected material may be shown.

Referring to FIGS. 8 and 9, collected material may be diverted through the turret 24 at an angle. At least some collected material (e.g., particulate matter) may only be routed through the chamber 102 after colliding with one or more internal walls of the chamber. In some embodiments, to accommodate for resultant wear from collisions with collected material, one or more internal walls making up the chamber 102 may be configured to be easily replaceable. For example, a back wall 112 may include a replaceable plate 104. In some embodiments, a horizontal wear plate 106 may be disposed about the edge 116. Horizontal wear plate 106 may extend beyond the edge 116 so that the edge 116 is protected even if some material is slowly lost from the wear plate 106 by erosion during use. To accommodate for ease of replacement of walls or plates included in the turret 24, the turret may include a housing 100 configured for ease of access to the chamber 102. For example, in some embodiments, the back wall 112 may include a latch 113. Latch 113 may include a threaded rod (positioned underneath cross bar 115) operably connected to a handle 110. The threaded rod may engage a catch 111 disposed on each side of the back wall 112. Release of the threaded rod from the catch 111 may allow a user to swing the back wall 112 to an open position. Replaceable plate 104 may, for example, be mounted within a slot formed in the back wall 112 so that it may be slidably removed or mounted as necessary. A group of pins 108 or other suitable mount may hold the replaceable plate 104 in position.

In some embodiments, turret 24 may be configured to interface directly with the boom assembly 20. For example, as shown in FIG. 8 and FIG. 9, collected material may be directed along a flow path (F) directly from the boom assembly 20 (through the sealed knuckle joint 22) to the turret chamber 102. Notably, this may be contrasted with other boom mounts which may be coupled to a boom assembly through an intermediate section of flexible hosing (e.g., a bellows tube).

Figure 10:
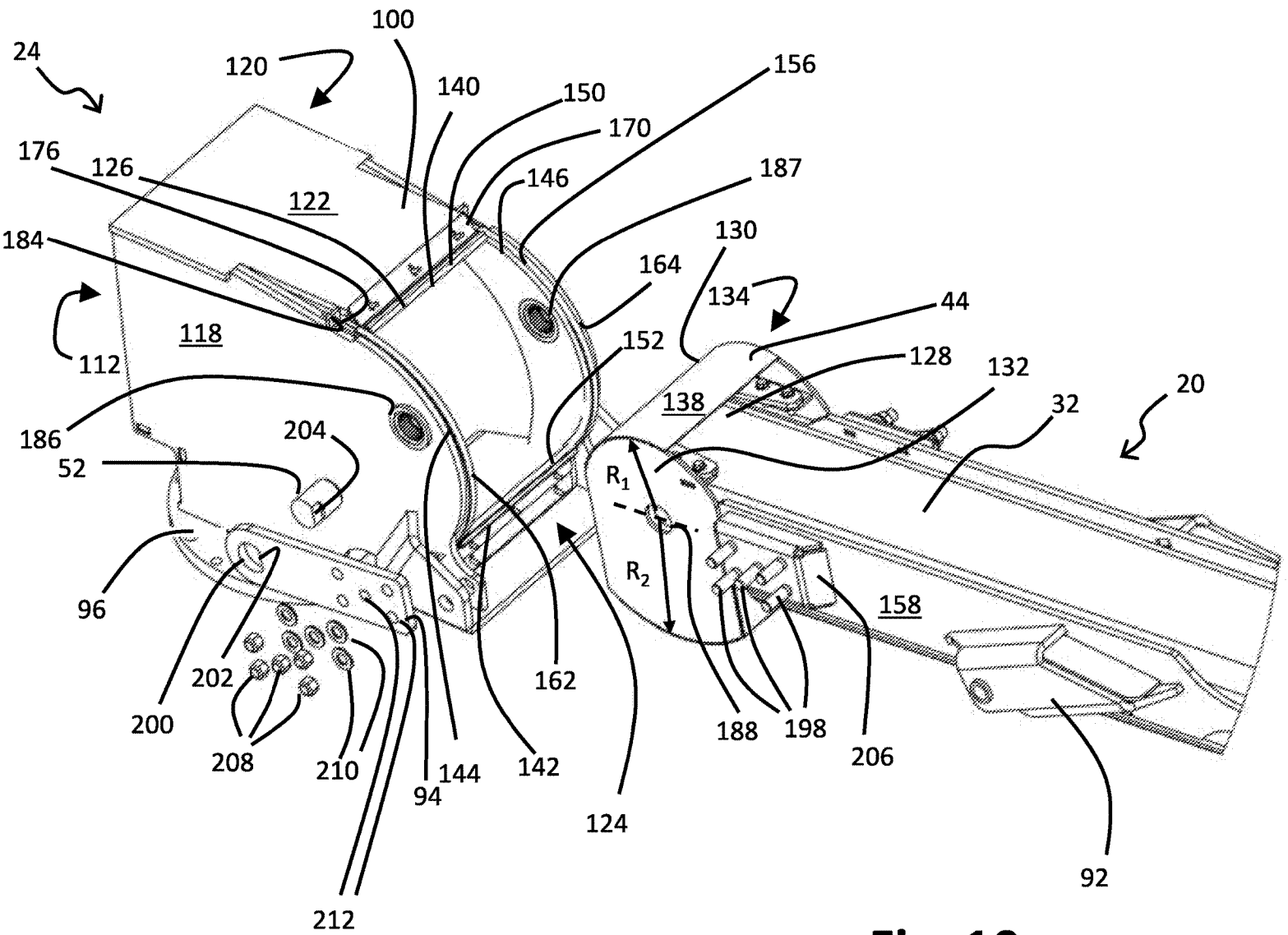
FIG. 10 is an exploded perspective view of the turret and boom assembly shown in FIG. 8. A proximal end of the boom assembly is shown being positioned for mounting to the turret.
Figure 11:
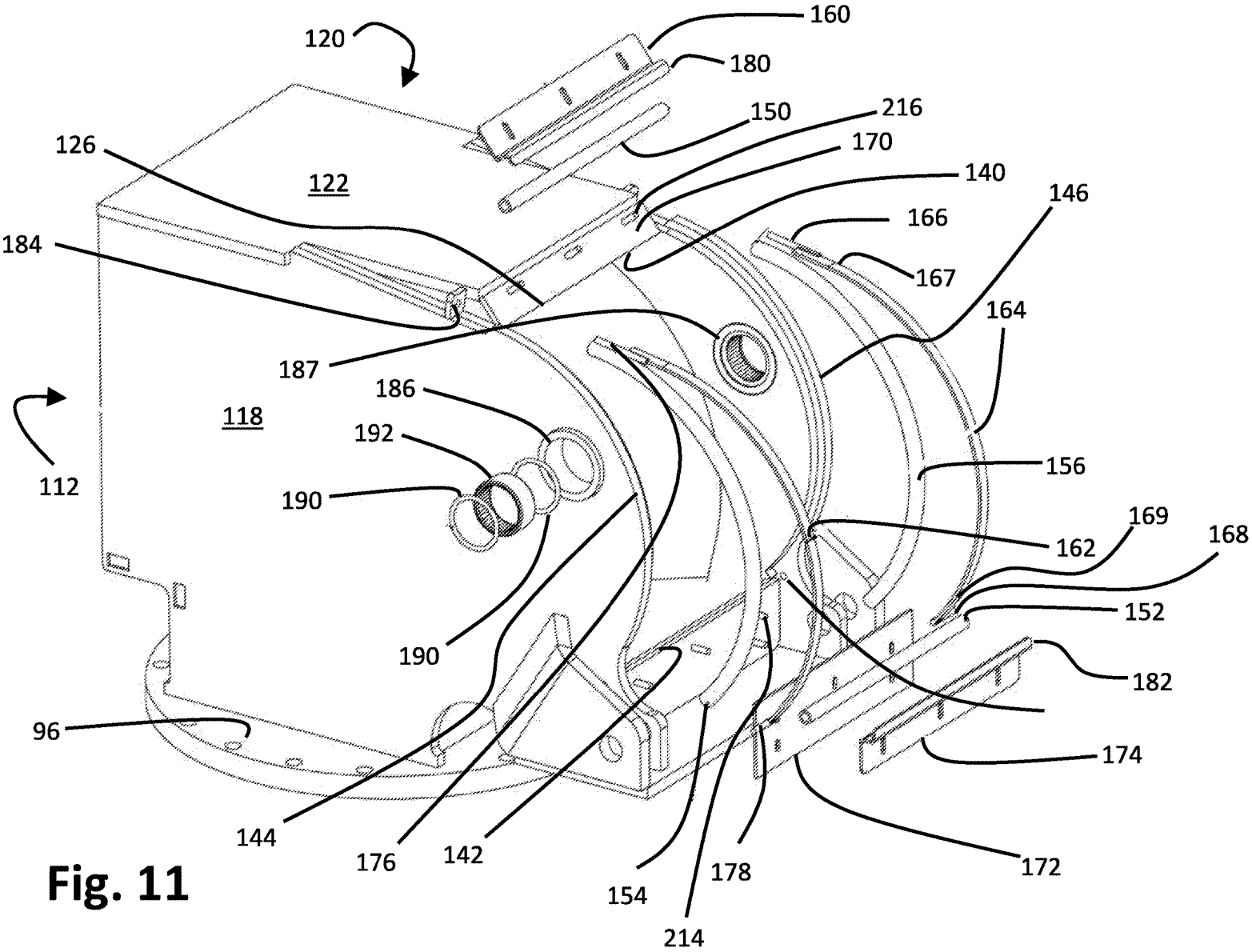
FIG. 11 is a partially exploded perspective view of the turret shown in FIG. 8.

Turret 24 may be sealingly coupled to the boom assembly 20 through knuckle joint 22 to maintain sealing engagement between the turret 24 and the knuckle joint 22 throughout a range of motion of the knuckle joint. For example, FIG. 10 shows a perspective view of an embodiment of turret 24 positioned adjacent boom assembly 20 when coupling those elements together. In FIG. 10, the turret 24 and a proximal end of the boom assembly 20 are shown separated from each other to highlight a group of seal packings 150, 152, 154, and 156 as they may be mounted to the turret 24. FIG. 11 shows the turret 24 with the seal packings 150, 152, 154, and 156 and associated mounting structures exploded therefrom. In the illustrated embodiment shown in FIG. 11, a group of four seal packings is shown. However, in some embodiments, a seal may be made of one continuous band of seal packing. For example, a seal may be suitably shaped to include a continuous band that extends around an opening 126 formed in the turret 24.

Figure 14:
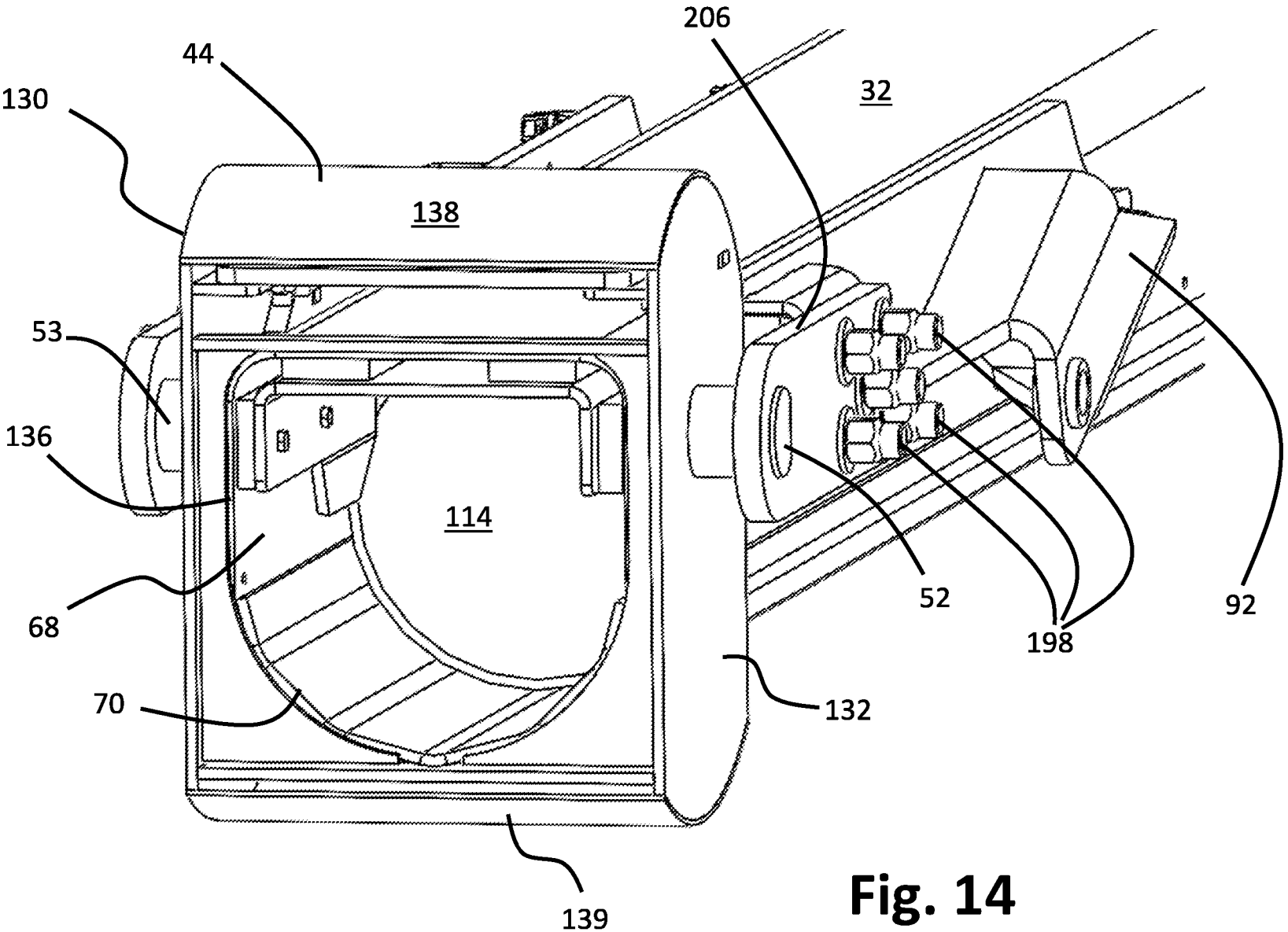
FIG. 14 is a perspective view of a boom assembly oriented to show the proximal end of the knuckle joint housing and an opening formed therein used for communication of collected material from the boom assembly to the turret.

As shown in FIGS. 10 and 11, turret 24 includes the housing 100. Housing 100 may include back wall 112, right side wall 118, left side wall 120, top wall 122, and front wall 124. In the embodiment shown in FIG. 10 and FIG. 11, the front wall 124 is substantially consumed by the turret opening 126. Turret opening 126 may be sized so that it receives a portion of the knuckle joint housing 44. Knuckle joint housing 44 is connected to the proximal end 128 of the boom assembly 20. For example, knuckle joint housing 44 may be connected to the first boom section 32 of boom assembly 20 using one or more weldments or using some one or more other suitable mounts, such as one or more bolts or pins, for example. In some embodiments, the knuckle joint housing 44 may include a generally C-shaped bracket 130, first side wall 132, and second side wall 134. As shown in each of FIG. 9 and FIG. 14, the housing 44 may include an opening 136. As shown in FIG. 9, when the knuckle joint housing 44 is at least partially received within turret opening 126 and sealingly coupled to the turret 24, the opening 136 forms an inlet for material transfer connecting boom assembly channel 114 to turret chamber 102 and therethrough to the vehicle body 12. Thus, knuckle joint 22 includes a housing 44 shaped to form an opening 136 disposed along a sealed path of fluid communication extending from the boom assembly 20 to the vehicle body 12. As shown in FIG. 14, in some embodiments, the generally C-shaped bracket 130 may include both an upper curved surface 138 and a lower curved surface 139. With further reference to FIG. 9, generally C-shaped bracket 130 may include a middle portion 135 that is shaped to form the opening 136. Thus, the bracket 130 may be C-shaped in profile along top and bottom portions thereof. However, the middle portion may be shaped in some other way such as irregular in shape, flattened or shaped in some other way to form the opening 136.

The vertical extent of turret opening 126 may be delineated by the top edge 140 and the bottom edge 142 of the turret opening. The horizontal extent of turret opening 126 may be delineated by the right-side edge 144 and the left-side edge 146 of the opening 126. A first seal packing 150 may be coupled to the turret 24 at or near the top edge 140. In some embodiments, first seal packing 150 may be positioned near the top edge 140 by sandwiching the packing 150 between a seal retainer 160 and a seal backing plate 170. For example, the first seal packing 150 may be positioned on seal backing plate 170. Seal retainer 160 may then be tightened or secured against seal backing plate 170 to sandwich the first seal packing 150 in place. For example, seal retainer 160 may be secured to the seal backing plate 170 using pins 216. Alternatively, some other connector such as, for example, screws or clips may be used to secure the seal retainer 160 to the seal backing plate 170. When the seal retainer 160 is secured on top of the seal packing 150, the seal packing may be held in position so that it sealingly abuts against a curved surface 138 of C-shaped bracket 130. In some embodiments, the seal retainer 160 may include a lip 180 shaped to receive the seal packing 150 and position the seal packing against the curved surface 138 of the C-shaped bracket 130.

In some embodiments, C-shaped bracket 130 may include a sheet of laser cut rolled steel. Notably, a bracket formed in this way may be made relatively smooth, which may be beneficial to help ensure that secure engagement between the seal packing 150 and the curved surface 138 of the knuckle joint housing 44 is maintained during pivoting motion of the knuckle joint 22. C-shaped bracket 130 may be curved to a radius so that the seal packing 150 maintains engagement with the knuckle joint housing 44 over a range of pivot positions of the knuckle joint 22. For example, as the boom assembly 20 is pivoted about knuckle joint 22, at least a portion of curved surface 138 of the C-shaped bracket 130 may sweep across seal packing 150 such that the gap between the seal packing 150 and curved surface 138 remains within a gap tolerance to maintain sealing engagement across a range of motion of the knuckle joint 22. The seal packing 150 may, for example, include a resilient material that is configured to slightly expand or contract to help maintain sufficient contact with curved surface 138 to aid in maintaining a fluid-tight sealed engagement therebetween. In some embodiments, seal packing 150 may include a material with suitable material properties so that it may slide over the surface 138 of the C-shaped bracket 130. For example, the seal packing 150 may be made of a material that minimizes friction between the surface 138 and the packing. In some embodiments, seal packing 150 may include a rope seal such as may be made from glass fibers. A rope seal may, for example, include interwoven glass fibers impregnated with a fluorine synthetic polymer, such as polytetrafluorethylene (PTFE), for example. Alternatively, in some embodiments, packing 150 may include a polyethylene foam, aramid fiber, or other suitable material. In some embodiments, the seal packings 152, 154, and 156 may be similarly composed.

A second seal packing 152 may be coupled to the turret 24 at or near the bottom edge 142 of the turret opening 126. The seal packing 152 may, for example, be sandwiched between a seal backing plate 172 and a seal retainer 174. In some embodiments, seal retainer 174 may include a lip 182 shaped to receive the seal packing 152 and assist in holding the seal packing 152 in place. A user may tighten the seal retainer 174 against the backing plate 172 to force the seal packing 152 into engagement with the knuckle joint housing 44 to provide a seal engagement between the turret 24 and the knuckle joint 22.

A third seal packing 154 may be coupled at or near the right-side edge 144 of the opening 126. Similarly, a fourth seal packing 156 may be coupled at or near the left-side edge 146 of the opening 126. Compression bands 162, 164 may be used to help hold the seal packings 154, 156 in place. For example, compression band 162 may be disposed adjacent the third seal packing 154. Compression band 162 may, for example, include or be made of a thin and flexible band of steel or aluminum. The compression band 162 may help to hold the seal packing 154 in place and may further help to maintain constant pressure on the seal packing 154 so that it is urged into sealing engagement with the side wall 132 of the knuckle joint housing 44. Likewise, compression band 164 may help to hold the seal packing 156 in place and may further help to maintain constant pressure on the seal packing 156 so that it is urged into sealing engagement with the side wall 134 of the knuckle joint housing 44.

Figure 13:
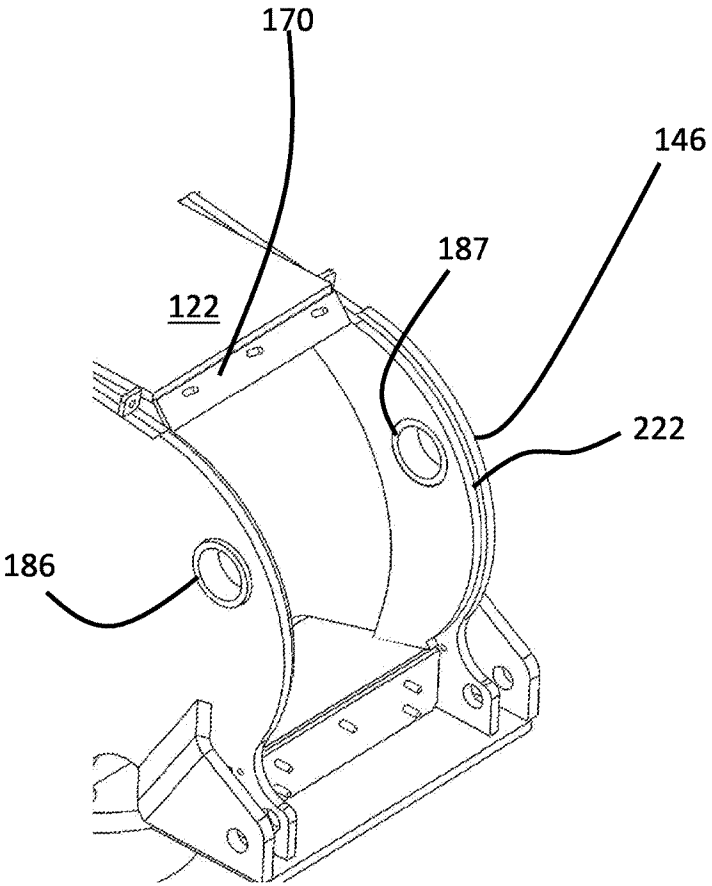
FIG. 13 is another perspective view of portions of the turret, knuckle joint, and boom assembly shown in FIG. 12.
Figure 12:
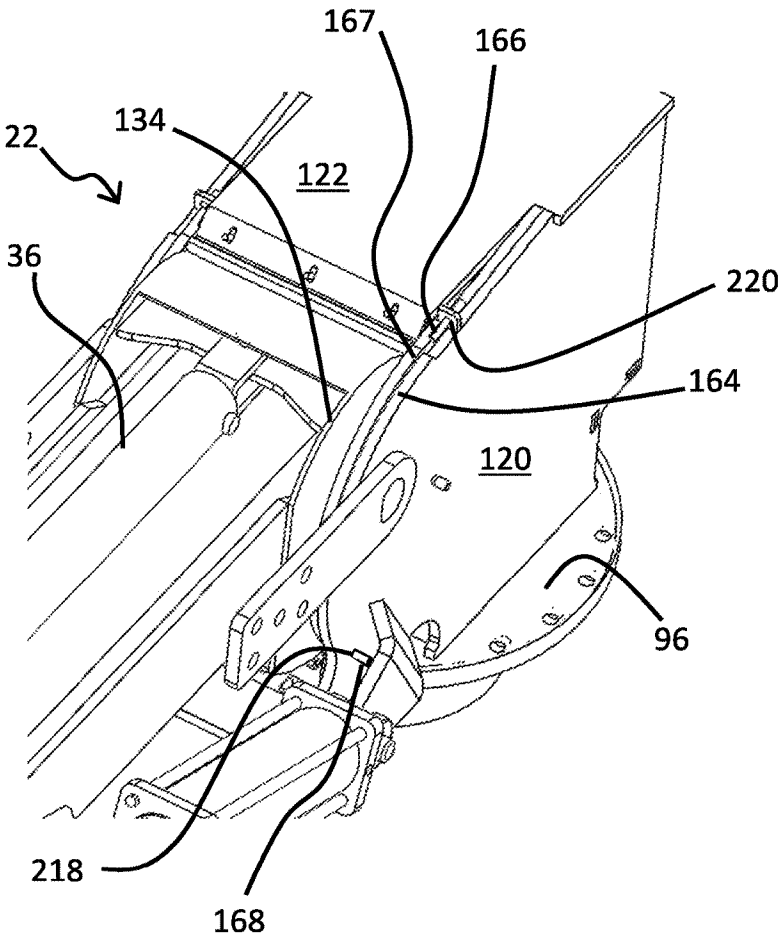
FIG. 12 is a perspective view of an embodiment of a turret connected to a boom assembly through a knuckle joint.

For example, with additional reference to FIGS. 12 and 13, in some embodiments, the compression band 164 may include a pair of pegs 166, 168 disposed on the top end 167 and bottom end 169 of the compression band. Similarly, the compression band 162 may include a pair of pegs 176, 178. The pegs 166, 168, 176, 178 may be configured to couple to one or more slots or holes formed in the turret housing 100. For example, the peg 176 may be coupled to a slot or hole 184 formed at the edge between the top wall 122 and the right-side wall 118. The peg 178 may couple to a slot or hole (not shown) at a bottom edge of the right-side wall 118. Similarly, as shown in FIG. 12, the peg 166 of compression band 164 may be coupled to the hole 220. The peg 168 of compression band 164 may be coupled to a slot or hole 218. The compression band 164 may, for example, be held in tension between the holes 218, 220 so that it acts as a backing for the seal packing 156 so that the seal packing is held between the compression band 164 and an inner ridge 222 (shown in FIG. 13) formed along the left-side edge 146 of the opening 126. Compression band 162 may be similarly installed.

Figure 15:
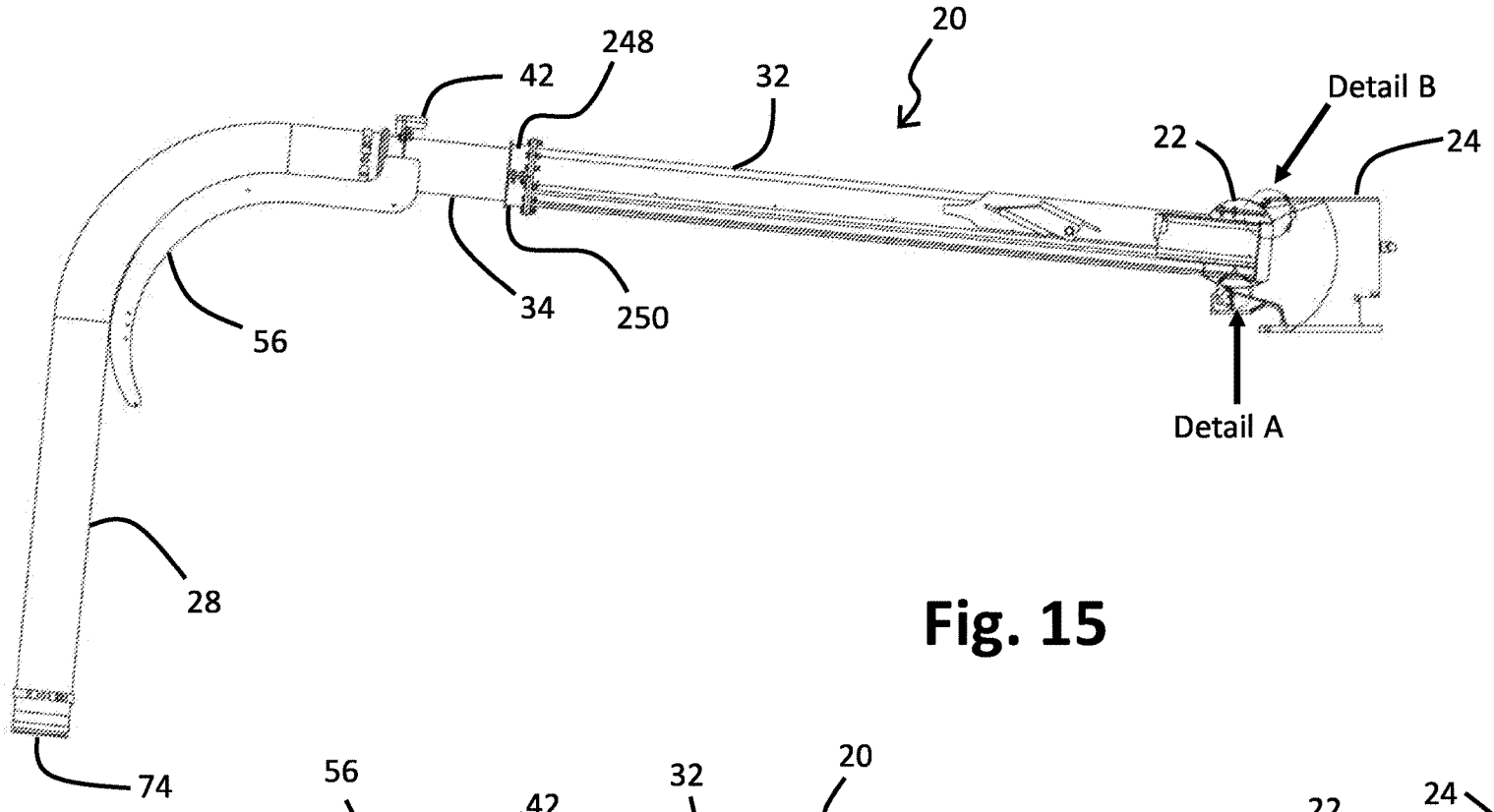
FIG. 15 is a left-side elevational view of the boom assembly shown in FIGS. 4-6. The boundaries of detailed cross-section regions A and B are shown therein.
Figure 16:
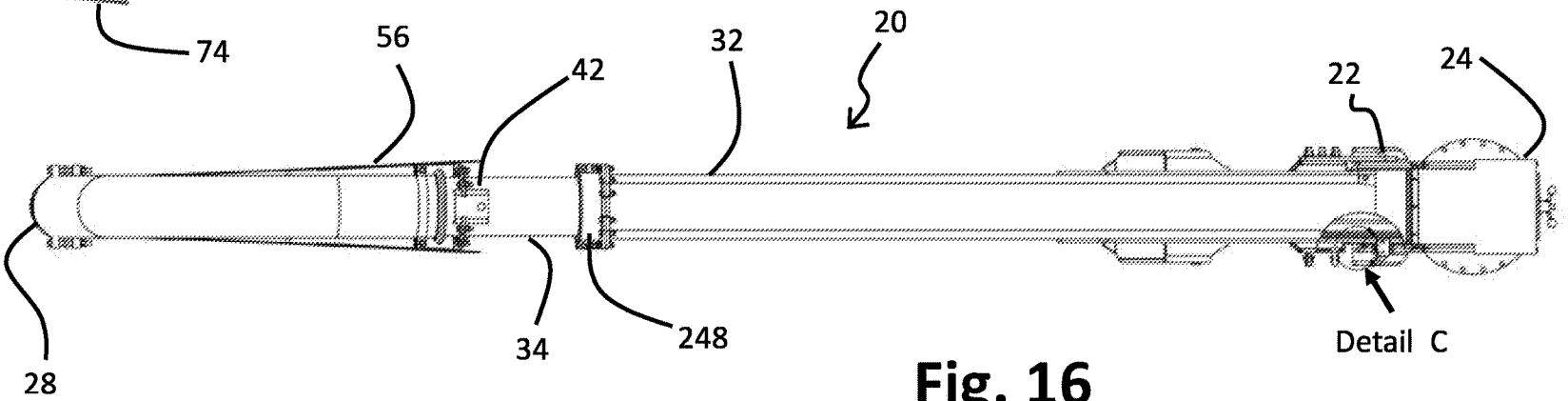
FIG. 16 is a top plan view of the boom assembly shown in FIGS. 4-6. The boundary of the detailed cross-section region C is shown in FIG. 16.

An embodiment for sealing engagement between the boom assembly 20 and the turret 24 is further shown in FIGS. 15-19. FIG. 15 and FIG. 16 show views of the boom assembly 20 in a partially extended configuration and with the boom assembly coupled to the turret 24. FIG. 15 is a left-side side view of the boom assembly 20 and turret 24. FIG. 16 is a top plan view of the boom assembly 20 and turret 24.

Figure 17:
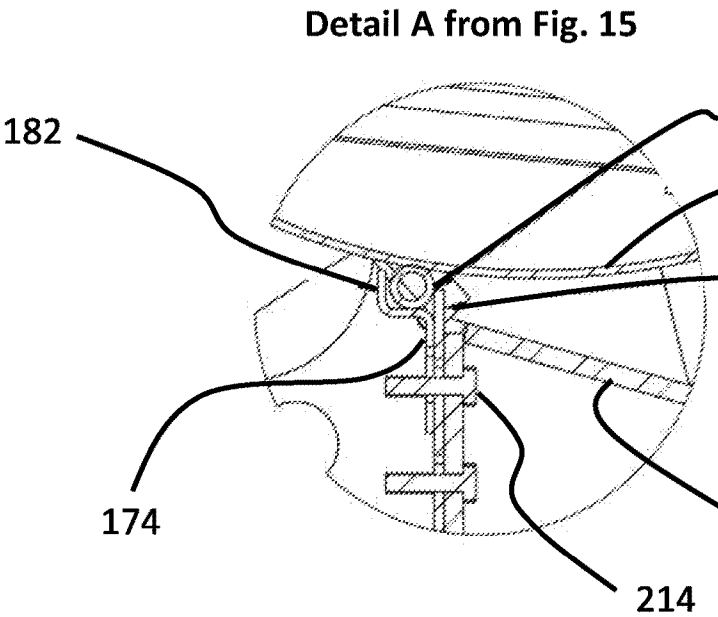
FIG. 17 is a detailed cross-section of region A of FIG. 15.
Figure 18:
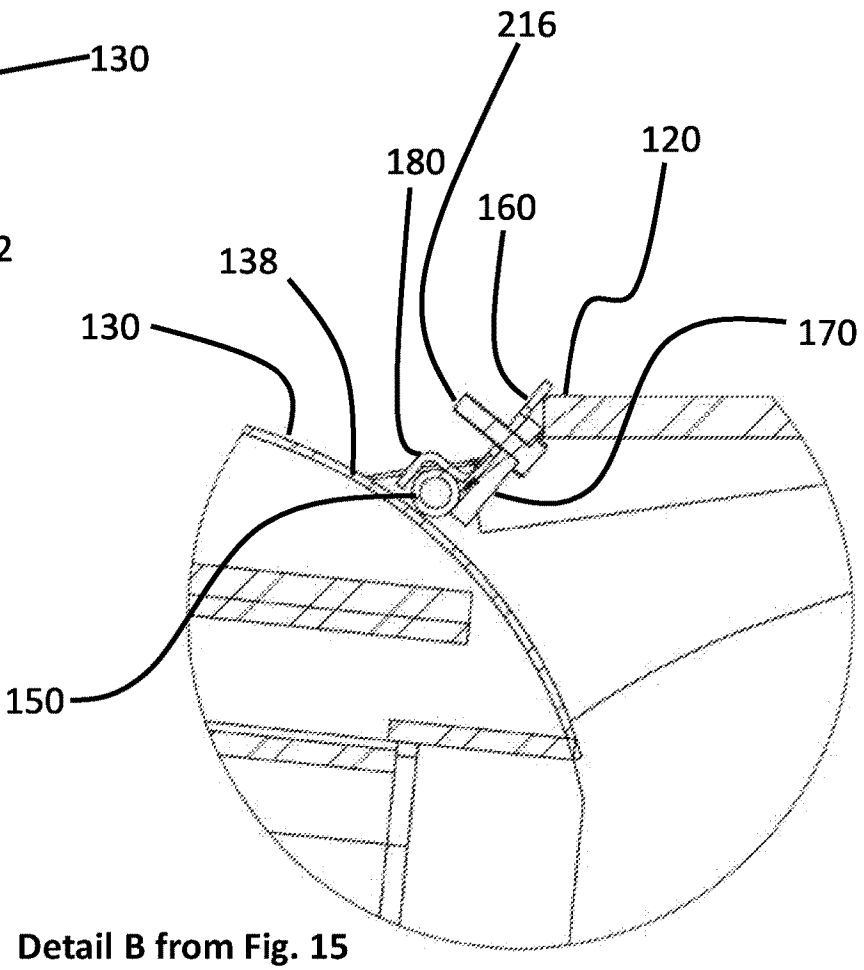
FIG. 18 is a detailed cross-section of region B of FIG. 15.

Referring to FIG. 15, the boundary of a cross-sectional area positioned about the seal packing 152 is shown as detail A. The boundary of a cross-sectional area positioned about the seal packing 150 is shown as detail B. Detail A is shown in FIG. 17. As shown therein, seal packing 152 may be sandwiched between seal backing plate 172 and bottom seal retainer 174. For example, seal packing 152 may be seated within lip 182. The backing plate 172 and bottom seal retainer 174 may, for example, be held in place using a collection of pins 214. Detail B is shown in FIG. 18. As shown therein, seal packing 150 may seat within the lip 180 of seal retainer 160. For example, when the seal retainer 160 is secured in place using pins 216 to mount the seal retainer to the seal backing plate 170, seal packing 150 may be positioned between lip 180 and seal backing plate 170 and held in position against the curved surface 138 of C-shaped bracket 130.

Figure 19:
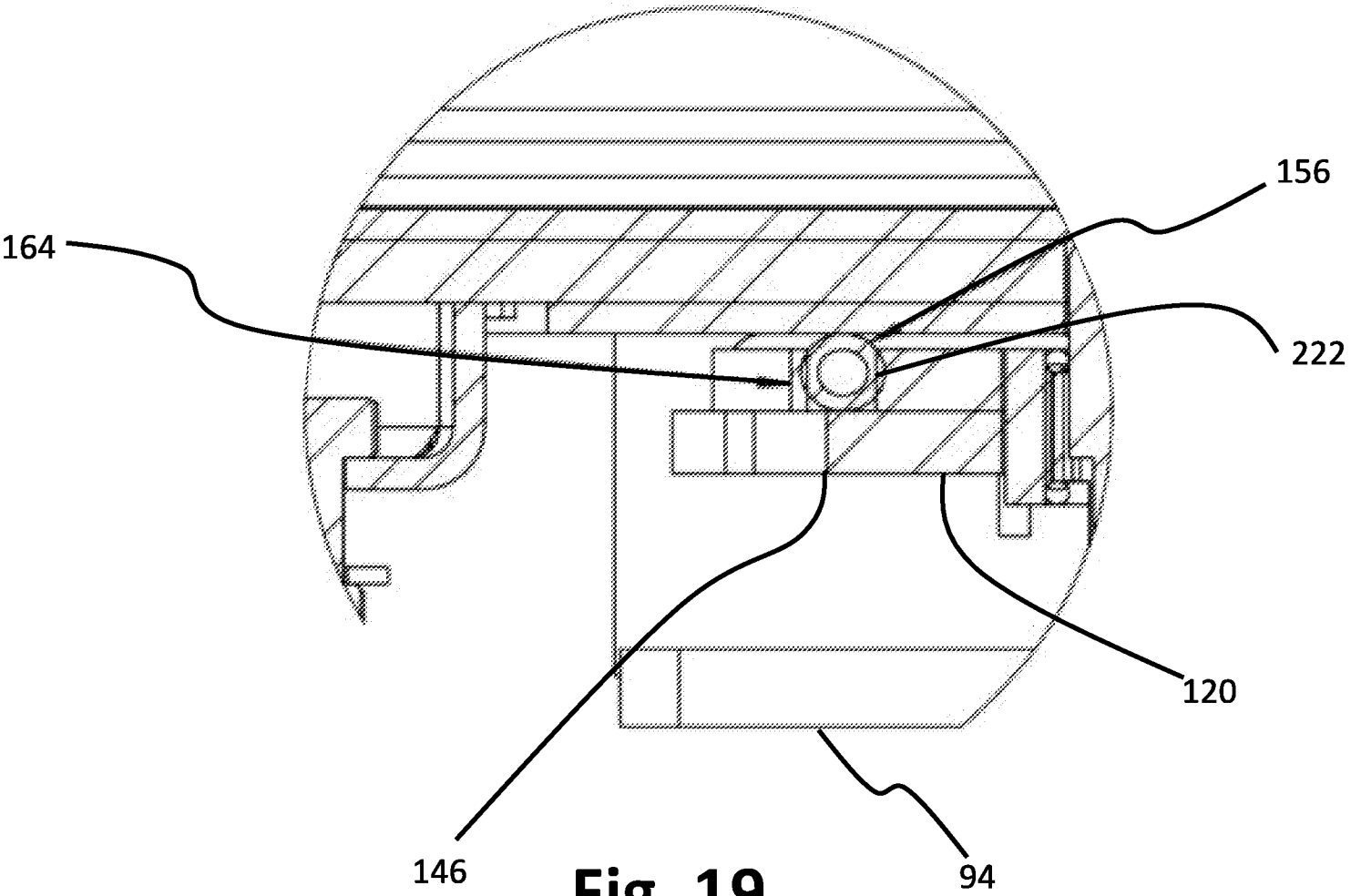
FIG. 19 is a detailed cross-section of region C of FIG. 16.

Referring to FIG. 16, the boundary of a cross-sectional area including the seal packing 156 and showing how the seal packing 156 is positioned between the C-shaped bracket 130 of boom assembly 20 and the turret 24 is shown as detail C. Detail C is shown in FIG. 19. As shown therein, the seal packing 156 may be held in place by compression band 164 and seated within ridge 222 formed on the edge 146 of left-side wall 120.

The knuckle joint 22 may be configured to pivot about one or more pivot pins. For example, with reference to FIG. 10, in some embodiments, the knuckle pin 52 may extend through a right-side turret opening 186 made in the turret. The knuckle pin 52 may further extend at least partially through an opening 188 made within the first side wall 132 of the knuckle joint housing 44. For example, in some embodiments, pin 52 may extend through right-side turret opening 186 and further extend through knuckle joint housing opening 188 but may not extend through a side wall 158 of first boom section 32. For example, the pin 52 may extend through the openings 186, 188 and terminate before it reaches the side wall 158 of first boom section 32. Alternatively, the pin 52 may extend through the openings 186, 188 and abut against a stop 196 (shown in FIG. 8). Stop 196 may, for example, include an indentation in the side wall 158 of first boom section 32. In both embodiments, the pin 52 does not extend through the side wall 158 so that the pin 52 does not, for example, extend all the way through the boom assembly 20. An equivalent pivot or knuckle pin 53 (shown in FIG. 14, for example) may extend through a left-side turret opening 187 made in the left-side wall 120 of the turret 24. The knuckle pin 53 may further extend through a corresponding opening (not shown) in the second side wall 134 of the knuckle joint housing 44. The knuckle pin 53 may, for example, extend through opening 187 and an opening in second side wall 134 of the knuckle joint housing 44 and terminate on a corresponding groove or stop on the opposite side of the boom assembly 20.

Figure 24:
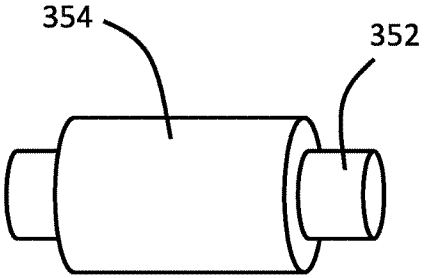
FIG. 24 is a schematic perspective view of a knuckle joint pivot pin protected by a sleeve.

Notably, in the above embodiments, neither of the pins 52, 53 extends completely through the boom assembly 20 so that they are not exposed within the channel 114. In some embodiments, a single knuckle pin may extend fully through the boom assembly 20. For example, a knuckle pin may extend through channel 114 and be exposed therein. Alternatively, a single knuckle pin may extend through a sleeve or covering protecting the knuckle pin within channel 114. For example, as shown in FIG. 24, a knuckle joint pin 352 may extend through a sleeve 354. In some embodiments, the knuckle joint 22 may be used to rotatably mount the boom assembly 20 to the turret 24 about the knuckle joint pin 352.

In some embodiments, one or more knuckle pin collars may further be used to assist in holding the knuckle pins 52, 53 in place. For example, a knuckle pin collar and tapper pin may be disposed adjacent an interior wall of the knuckle joint housing 44 or disposed adjacent an inner wall of first boom section 32 (e.g., laying against a relatively flat portion of upper half pipe 68).

With reference to FIGS. 7 and 10, for example, the knuckle pin 52 may extend at least partially through an opening 188 made within the first side wall 132 of the knuckle joint housing 44. In some embodiments, the opening 188 may be positioned about equal distance from the top and bottom edges of the first side wall 132. Thus, the pivot point of the knuckle joint 22 may be centered within the knuckle joint housing 44. In other embodiments, the pivot point of the knuckle joint may be asymmetrically positioned in the knuckle joint housing 44. For example, as shown in FIG. 10, the distance ($R_1$) from the center of the opening 188 to a top edge of the first side wall 132 may be different from the distance ($R_2$) from the center of the opening 188 to a bottom edge of the first side wall 132. In some embodiments, the ratio of ($R_1$) to ($R_2$) or ($R_1$:$R_2$) may be about 0.6:1.0 to about 0.95:1.0. In some embodiments, ($R_1$:$R_2$) may be about 0.8:1.0 to about 0.95:1.0.

A pair of actuators, including right-side actuator 88 (shown in FIG. 7, for example) and a similar left-side actuator (not shown) may be used to power pivotal motion of the boom assembly 20. The left-side actuator may, for example, be an equivalent actuator to right-side actuator and may be disposed on the opposite side of the knuckle joint 22. When powered, right-side actuator 88 may transmit a rotational force on the pivot pin 52 through boom-pivot-pin retainer 94 (shown in both FIG. 7 and FIG. 10). Boom-pivot-pin retainer 94 may, for example, be secured to the pivot pin 52 via a weldment, for example. Boom-pivot-pin retainer 94 is further secured to the boom assembly 20 via the bracket 206. For example, with reference to FIG. 10, boom-pivot-pin retainer 94 may be secured to the bracket 206 using a set of screws or pins 198 shaped to fit over a set of through holes 212 in boom-pivot-pin retainer 94. The pins 198 may be secured thereto using a set of nuts 208 and washers 210. Boom-pivot-pin retainer 94 may include a plate including a shaped opening 200. Shaped opening 200 may, for example, include a flattened edge 202. Flattened edge 202 may abut against a complementary shaped notch 204 included on pivot pin 52 when boom-pivot-pin retainer 94 is secured about pivot pin 52. In this way, rotation of the pivot pin 52 is ensured with respect to the boom assembly 20 when the boom-pivot-pin retainer 94 is put in motion. That is, rotation of the boom-pivot-pin retainer 94 causes rotation of the pivot pin 52 through engagement between the flattened edge 202 and notch 204. The bearings 192 (sandwiched between bearing O-rings 190) help to ensure that torque is transmitted solely to the boom assembly 20 and not to the turret 24. A second boom pivot pin retainer 95 (shown in FIG. 20) may be mounted on the opposite side of the turret 24 for similar cooperation with pivot pin 53.

FIG. 20 shows an embodiment of the knuckle joint housing 44 wherein at least a portion of telescopic extend and/or retract actuator 36 is tucked within the housing (e.g., underneath the top portion of C-shaped bracket 130). As shown therein, the knuckle joint housing 44 includes the C-shaped bracket 130. In some embodiments, an edge 230 of the bracket 130 may extend over a cylinder mounting pin 221 and at least in part over other structures positioned adjacent to the proximal end 38 of the actuator 36. In this way, the knuckle joint housing 44 may shield and protect critical parts of the cylinder 62 (e.g., the cylinder's end cap 274) from the external environment. In some embodiments, the knuckle joint housing 44 may provide physical protection to critical parts of the cylinder 62. The knuckle joint housing 44 may further include a flexible rubber or plastic barrier coupled thereto and positioned at least at the border between the knuckle joint housing 44 and the first boom section 32. Thus, components positioned in an interior space 61 enclosed by the knuckle joint 44 may be protected from physical damage and other environmental concerns. The proximal end of the cylinder 62 may, for example, extend through the barrier and into the interior space 61 underneath the knuckle joint housing so that it is protected from both physical and other environmental concerns. The cylinder mounting pin 221 may, for example, be mounted to a U-shaped bracket 60. The U-shaped bracket 60 may be connected to a pair of flanges 260 welded to each side of the knuckle joint housing 44. For example, the U-shaped bracket 60 may be connected to the flanges 260 via fasteners 272, (e.g., screws, bolts, or pins). The fasteners 272 may be positioned for relatively easy access so that a maintenance engineer may, for example, remove the fasteners to free the cylinder 62 from the knuckle joint 22. For example, in some embodiments, the fasteners 272 are connected to the U-shaped bracket 60 at a position distal from the turret 24 so that the cylinder mounting pin 221 is positioned deeper within the knuckle joint housing 44 than are the fasteners 272. For example, the U-shaped bracket 60 may curl around the end cap of the cylinder 62 (e.g., including a pair of arms 223, 225) to project distally away from the mounting pin 221 to position the fasteners 272 towards a more accessible location. In some embodiments, to remove the cylinder 62, a user may remove the fasteners 272 and pull the cylinder 62 away from the knuckle joint housing 44. In some embodiments, the U-shaped bracket 60 may be shaped to curl around the end cap 274 of the actuator 36 to position the one or more fasteners 272 distally from the end cap to a position wherein a user may fit a tool (e.g., a hex key or wrench) within the interior space 61 enclosed by the joint housing 44 and remove the one or more fasteners 272 to disengage the U-shaped bracket from the knuckle joint housing 44 (or from a ball-shaped housing 526 as shown in FIG. 26, for example). Likewise, the cylinder 62 may be inserted underneath the knuckle joint housing 44 into the interior space 61 formed therein when installing the actuator 36 and the one or more fasteners tightened to secure the actuator 36 for use. Thus, the actuator 36 may be reversibly coupled to the knuckle joint housing 44 when installing the actuator for use or removing the actuator 36 during maintenance, the one or more fasteners 272 being configured for reversibly coupling the bracket to the joint housing. The U-shaped bracket 60 and cylinder mounting pin 221 may remain attached to the cylinder 62 in such operations.

In some embodiments, the edge 230 of the C-shaped bracket 130 may be a shaped or curved edge. For example, the C-shaped bracket 130 may extend further than shown in FIG. 20 and include an edge 230 that is curved more closely around the cylinder 62. In this way the knuckle joint housing 44 may more completely protect the end cap 274 of the actuator 36.

Figure 22:
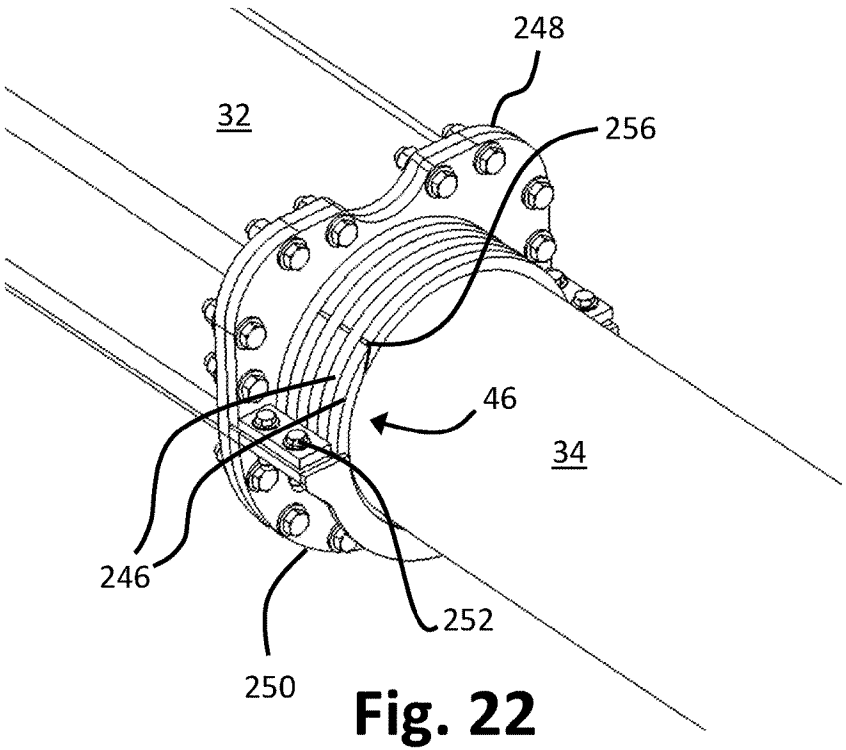
FIG. 22 is another perspective view of the bearing seal of FIG. 21 coupled between first and second boom sections of an extendable boom assembly.
Figure 21:
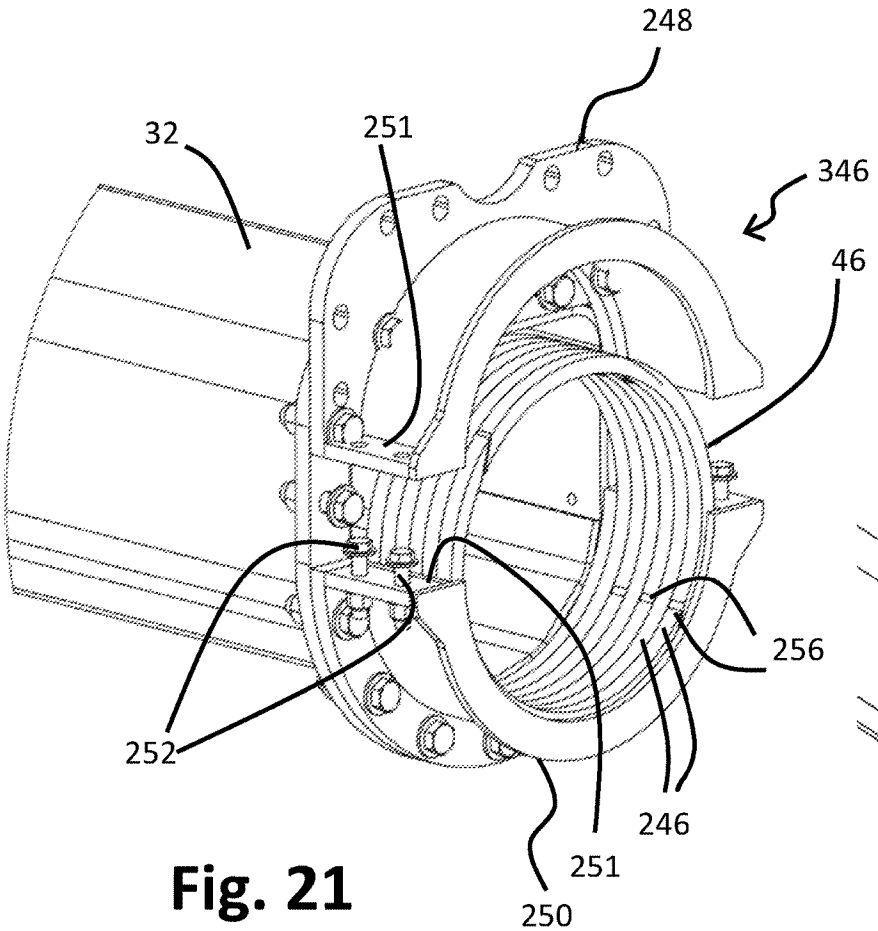
FIG. 21 is a perspective view of an embodiment of a bearing seal.

In some embodiments, the first boom section 32 may be sealingly coupled to the second boom section 34. Accordingly, collected material or debris including fluid debris may sealingly pass directly through both first boom section 32 and second boom section 34 without requiring any flexible hosing or tubing received therein. For example, the first boom section 32 and the second boom section 34 may be sealingly coupled together using the bearing seal 346. In FIG. 21, an embodiment of the bearing seal 346 is shown. As shown therein, in some embodiments, the bearing seal 346 may include a bearing 46, an upper bearing clamp 248, and a lower bearing clamp 250. In FIG. 21, the bearing seal 346 is shown with one end of the bearing seal 346 connected to the first boom section 32. To help visualize the structure of the bearing 46, the upper bearing clamp 248 is shown slightly offset from the bearing 46 as it might be positioned before it is tightened onto the bearing 46. In FIG. 22, a portion of the bearing 46 is shown coupled or wrapped around the second boom section 34. In FIG. 22, the upper bearing clamp 248 is omitted from view for clarity.

Figure 25:
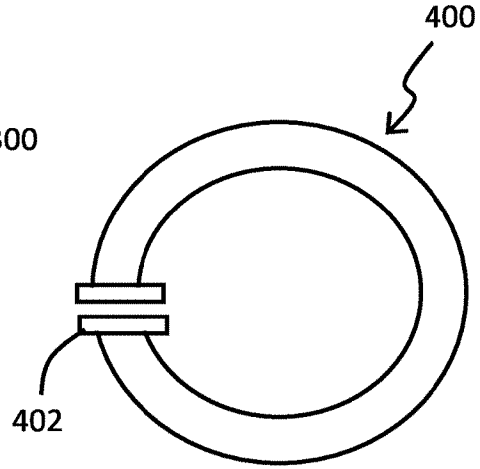
FIG. 25 is a schematic view of an embodiment of a bearing clamp.

As shown in FIG. 21 and FIG. 22, in some embodiments, the bearing 46 may include a group of overlapping pieces 246 of a deformable material including, for example, a thermoplastic polymer such as high-density polyethylene (HDPE). For example, in some embodiments, the bearing 46 may be segmented to include a group of 12 overlapping half round pieces 246 or segments of overlapping HDPE. Of course, some other suitable number of segments may be used. In some embodiments, the segments may be more or less than half round. In the bearing seal 346 the bearing 46 may be held in place by the pair of bearing clamps 248, 250. However, the bearing 46 may be held in place in some other way. For example, as shown in FIG. 25, a single bearing clamp 400 may be used to hold the bearing 46 in place. For example, a single bearing clamp 400 may be circularly shaped so that it fits around the bearing 46. The bearing clamp 400 may include a gap 402 and use one or more bolts or screws 252 to tighten and secure the clamp 400 around the bearing. Referring again to FIGS. 21 and 22, upper bearing clamp 248 may, for example, be tightened to lower bearing clamp 250 using a set of bolts or screws 252. As the bearing 46 is clamped between the upper bearing clamp 248 and the lower bearing clamp 250, the bearing 46 may flex or deform as needed to form a seal-tight interface between the bearing clamps 248, 250 and the second boom section 34. For example, in some embodiments, each of the segments 246 may be wound around slightly less than one-half of the circumference of the second boom section 34. In this configuration, a small gap 256 may be formed between two adjacent segments 246. As the segments 246 are pressed by the bearing clamps 248, 250, adjacent segments 246 may deform or flex to fill the gap 256. The gap 256 may provide a space for the segments 246 to deform or flex into a suitable shape for sealing engagement. Notably, without this gap 256, the segments 246 may be deformed under pressure by the bearing clamps 248, 250 and buckle or otherwise unseat from their desired position and compromise the sealing engagement. The first boom section 32 may also be sealed against the bearing clamps 248, 250 to complete sealing engagement of the first boom section 32 to the second boom section 34 using the bearing seal 346. For example, sealing engagement between the clamps 248, 250 may be secured when tightening the clamps together through the flanges 251.

Figure 28:
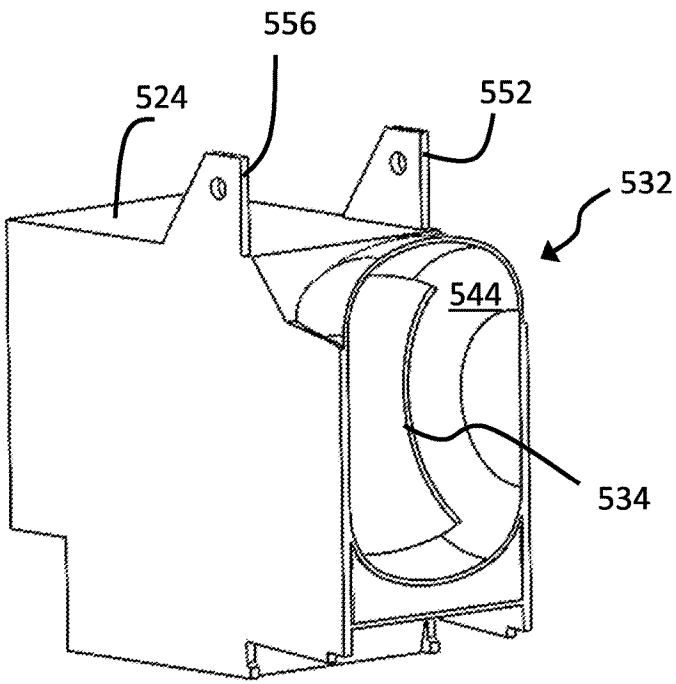
FIG. 28 is a perspective view of an alternative embodiment of a turret.
Figure 27:
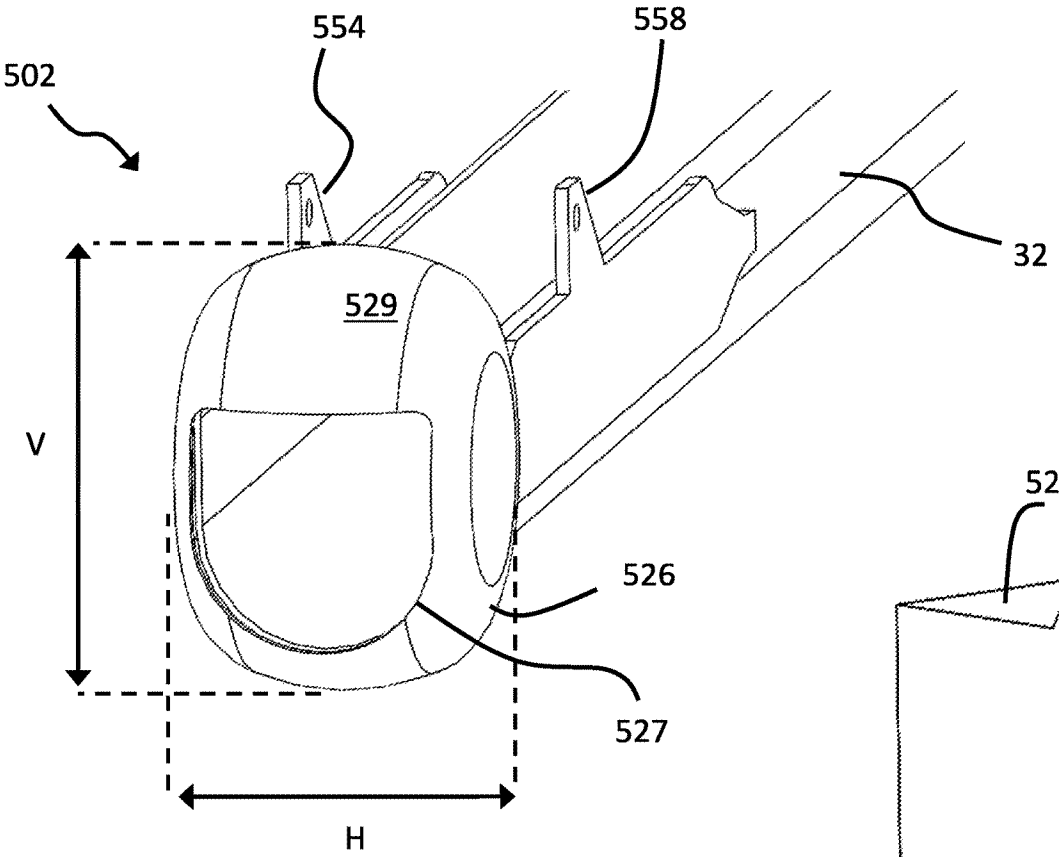
FIG. 27 is a perspective view of an embodiment of a boom assembly oriented to show the proximal end of a housing of a ball-and-socket joint.
Figure 29:
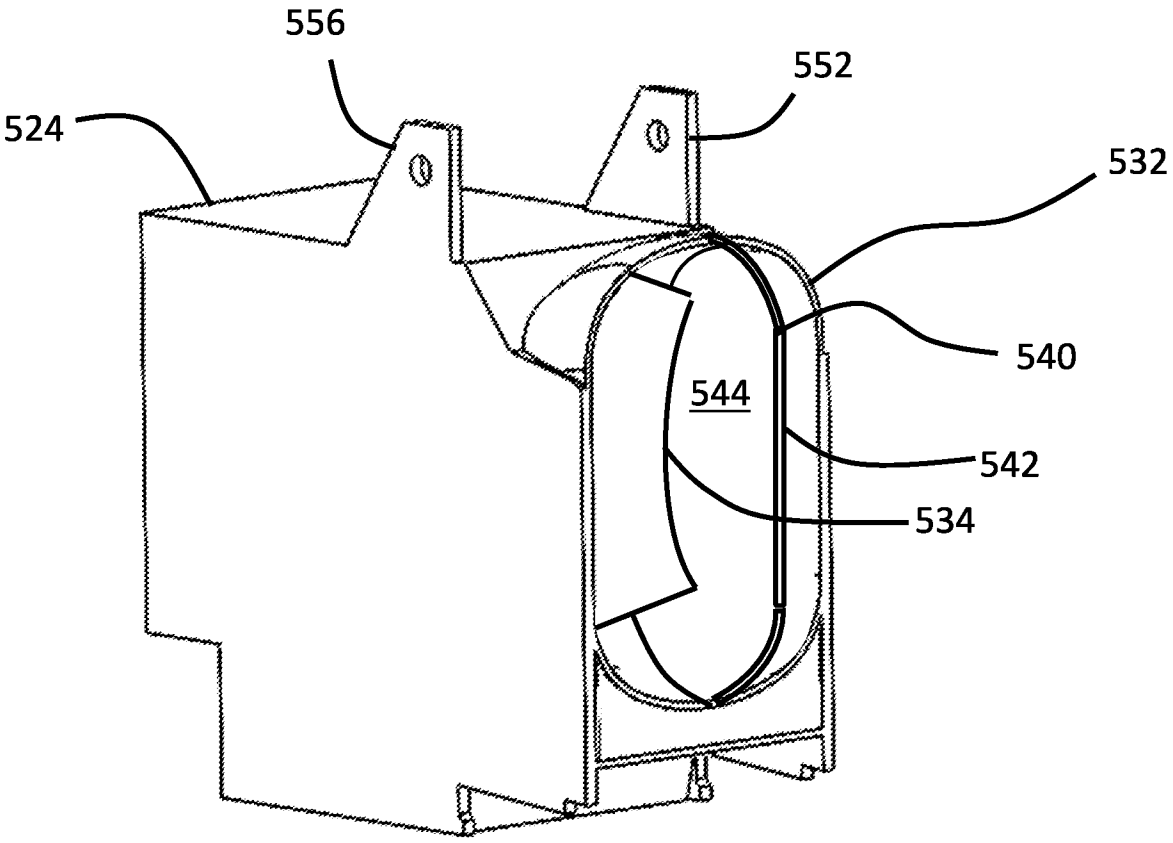
FIG. 29 is a perspective view of the turret shown in FIG. 28 including a seal.

An alternative embodiment of an adjustable mounting system 500 for a boom assembly 502 is shown in FIG. 26. As shown therein, the mounting system 500 may include turret 524 and ball-and-socket joint 522. The mounting system 500 may be further understood in view of FIGS. 27-29. FIG. 27 is a perspective view of the boom assembly 502 oriented to show the proximal end of a generally ball-shaped housing 526 of the ball-and-socket joint 522. As shown therein, the ball-shaped housing 526 includes an opening 527 formed therein used for communication of collected material from the boom assembly 502 to the turret 524. FIG. 28 is a perspective view of an embodiment of the turret 524. As shown therein, the turret 524 may include a socket 532 with an opening 534 formed therein. FIG. 29 is a perspective view of another embodiment of turret 524. As shown therein, a seal 540 may be disposed within the socket 532. For example, the seal 540 may be disposed in a groove 542 formed within a socket wall 544. The opening 527 formed in the housing 526 and the opening 534 formed in the socket 532 may be aligned at least in part when the housing 526 is seated in the socket 532 so that material may pass through the aligned openings 527, 534 during routing of material from the boom assembly 502 to the turret 524 and then to vehicle body 12. For example, as similarly described for turret 24 and boom assembly 20 (shown in FIG. 9, for example), the turret 524 may include an internal turret chamber 102 for receiving collected material routed from the boom assembly 502 through the ball-and-socket joint 522. Material received within the turret chamber 102 may then be routed to the vehicle body 12. For example, turret 524 may be mounted to the vehicle body 12 (not shown in FIG. 26) using plate 96 as described above for turret 24. As shown in FIG. 9, plate 96 may include an opening or valve 76 placing the turret chamber 102 in communication with the vehicle body 12 so that collected material may pass therethrough in routing of material to the vehicle body 12 for collection in collection tank 30, for example.

In some embodiments, plate 96 may be mounted to the vehicle body 12 using bearings 98 so that the turret 524 may be rotatably coupled to the vehicle body 12. For example, the turret 524 may be configured for powered rotation so as to rotate the turret 524 to the right side or the left side of the vehicle body 12 as necessary for material collection. Alternatively, the turret 524 may be mounted on bearings 98 so as to enable a user to manually rotate the turret (e.g., by swinging the boom assembly 502 as necessary) for material collection. However, in some embodiments, the turret 524 may be non-rotatably coupled to the vehicle body 12. For example, plate 96 may secure the turret 524 to the vehicle body 12 using one or more pins, bolts, or weldments, for example. In some of the above embodiments, increased flexibility afforded by the ball-and-socket joint 522 (e.g., over some other joints with more limited movement capability) may facilitate ease of positioning of the boom assembly 502 for material collection without demanding a rotatable or at least fully 3600 rotatable turret.

As shown in FIG. 26 (with additional reference to FIGS. 27 and 28), in some embodiments, the ball-shaped joint housing 526 may be generally spherical or spheroidal in its exterior shape. The ball-shaped joint housing 526 may further be configured to seat within a complementary shaped socket 532. For example, the ball-shaped joint housing 526 may be generally spherical in shape and configured for seating within a complementary shaped socket 532 (e.g., a socket forming a spherical shape in the space defined by the socket's opening). Accordingly, in some embodiments, the joint housing 526 may be configured for substantially free movement within the socket 532 over a certain range of motion. For example, the ball-shaped joint housing 526 may rotate within the socket 532 so that the boom assembly 502 may pivot about any number of axes centered on ball-and-socket joint 522. Regardless of the exterior shape of joint housing 526, the flow path through the interior of joint housing 526 may be of any suitable cross-sectional shape (e.g., circular, oval, polygonal, irregular, or a combination thereof).

In some embodiments, the ball-shaped joint housing 526 may be generally spheroidal in shape or include an imperfect sphere so that it may be extended in length in one direction over another. For example, as shown in the embodiment illustrated in FIG. 27, a vertical extent (V) of the joint housing 526 may be greater than a horizontal extent (H) of the joint housing 526. In some such embodiments, the coupling between the ball-shaped joint housing 526 and the socket 532 may be configured so as to allow for pivoting motion of joint housing 526 about each of a vertical axis ($A_2$) and a horizontal axis ($A_3$). Accordingly, the boom assembly 502 may, for example, be configured for movement both upwards and downwards and in a side-to-side direction. Thus, the ball-and-socket joint 522 may still enable considerable flexibility when positioning the boom assembly 502 for material collection. However, in some of those embodiments, the ball-shaped joint housing 526 may be coupled to the socket 532 to inhibit free rotation of the ball-shaped joint housing 526 within the socket 532 in certain directions. For example, as shown in FIG. 26, the joint housing 526 may move within the socket 532 to allow the boom assembly 502 to pivot about the axis ($A_2$) (e.g., when moving side-to-side when positioning the boom assembly 502 for material collection). The joint housing 526 may also move within the socket 532 to allow the boom assembly 502 to pivot about the axis ($A_3$) (e.g., when moving vertically upwards or downwards when positioning the boom assembly 502 for material collection). However, the coupling between the ball-shaped joint housing 526 and the socket 532 may prevent free movement of the ball-shaped joint housing 526 about other axes. This may be advantageous for some embodiments of ball-and-socket joint 522 including, for example, some embodiments wherein the boom assembly 502 is configured to operate at significant extended lengths in a cantilevered position. To that point, by limiting the rotation of the ball-shaped joint housing 526 in the socket 532, the stability of the joint 522 when the boom assembly 502 is subject to tensile, torsional, or bending loads may be improved. Accordingly, the joint 522 may remain reliable even when the boom assembly 502 is subjected to significant tensile, torsional, or bending loads that may sometimes be experienced when the boom assembly 502 is positioned in a significantly extended cantilevered state.

As shown in FIG. 27, in some embodiments, the joint housing 526 may include a curved surface 529 forming a continuous boundary surrounding the opening 527. The surface 529 may provide a smooth contact area upon which a seal packing may be sealingly engaged. In some embodiments, as shown in FIG. 29, one or more seals 540 may be mounted within the socket 532. For example, in some embodiments, one or more seals 540 (e.g., a continuous rope seal) may be positioned in a groove 542 formed within a wall 544 of the socket 532. In some embodiments, one or more compression bands may be used to help secure the seal 540 within the groove 542. Alternatively, a seal 540 may be secured to the wall 544 using an adhesive, for example. In some embodiments, sealing between the turret 524 and the joint housing 526 may be achieved using a thin (e.g., less than about ¼" thick) sheet of High-density polyethylene or using a rope seal, for example, or a press-fit, or a combination thereof.

In some embodiments, the joint housing 526 may be secured to first boom section 32. For example, joint housing 526 may be secured to first boom section 32 using a weldment or using one more supporting brackets and pins, for example. In some embodiments, the boom assembly 502 may, for example, be similarly configured as is the boom assembly 20 (shown in FIG. 10, for example) so that it may, for example, include each of a first boom section 32 and a second boom section 34 and may be telescopically extendable in length. However, the boom assembly 502 shown in FIGS. 26 and 27 may be coupled to a ball-shaped joint housing 526 shaped so that it may seat within the socket 532. Telescopic extension and/or retraction of the boom assembly 502 may, for example, be driven using the actuator 36. As similarly shown in FIG. 20, one or more components of the actuator 36 (e.g., end cap 274 or cylinder mounting pin 221) may, at least in part, be confined within and protected by the ball-shaped joint housing 526 or socket 532.

One or more additional actuators may be used for actuation of the boom assembly 502. For example, in the illustrated embodiment shown in FIG. 26, a left-side actuator 550 may be disposed on a left-side of the boom assembly 502. A similar right-side actuator (disposed on the right-side of the boom assembly 502) is omitted from view in FIG. 26 for clarity. Powered extension and/or retraction of the left-side actuator 550 and right-side actuator may be used to position the boom assembly 502 as may be required during material collection. For example, by controlled actuation of the left-side actuator 550 and right-side actuator, the boom assembly 502 may engage in pivoting motion about the axes ($A_2$) and ($A_3$) or other axes (if suitably configured). In some embodiments, the left-side actuator 550 and the right-side actuator (not shown) may be mounted on top of the turret 524. For example, left-side actuator 550 may be pinned to the turret 524 using a first bracket 552. The left-side actuator 550 may further be pinned to the boom assembly 502 using a second bracket 554. Likewise, the right-side actuator may be mounted using the brackets 556, 558. In some embodiments, one or more straps (not shown) may be used to help secure the boom assembly 502 in place. For example, a strap may be secured on either side of the turret 524 and extend around the joint housing 526 to help keep the joint housing 526 in place and secured within the socket 532. Although pin connections are shown, other suitable connections may be used (e.g., universal joints, ball joints, etc.) for the actuators.

Figure 30:
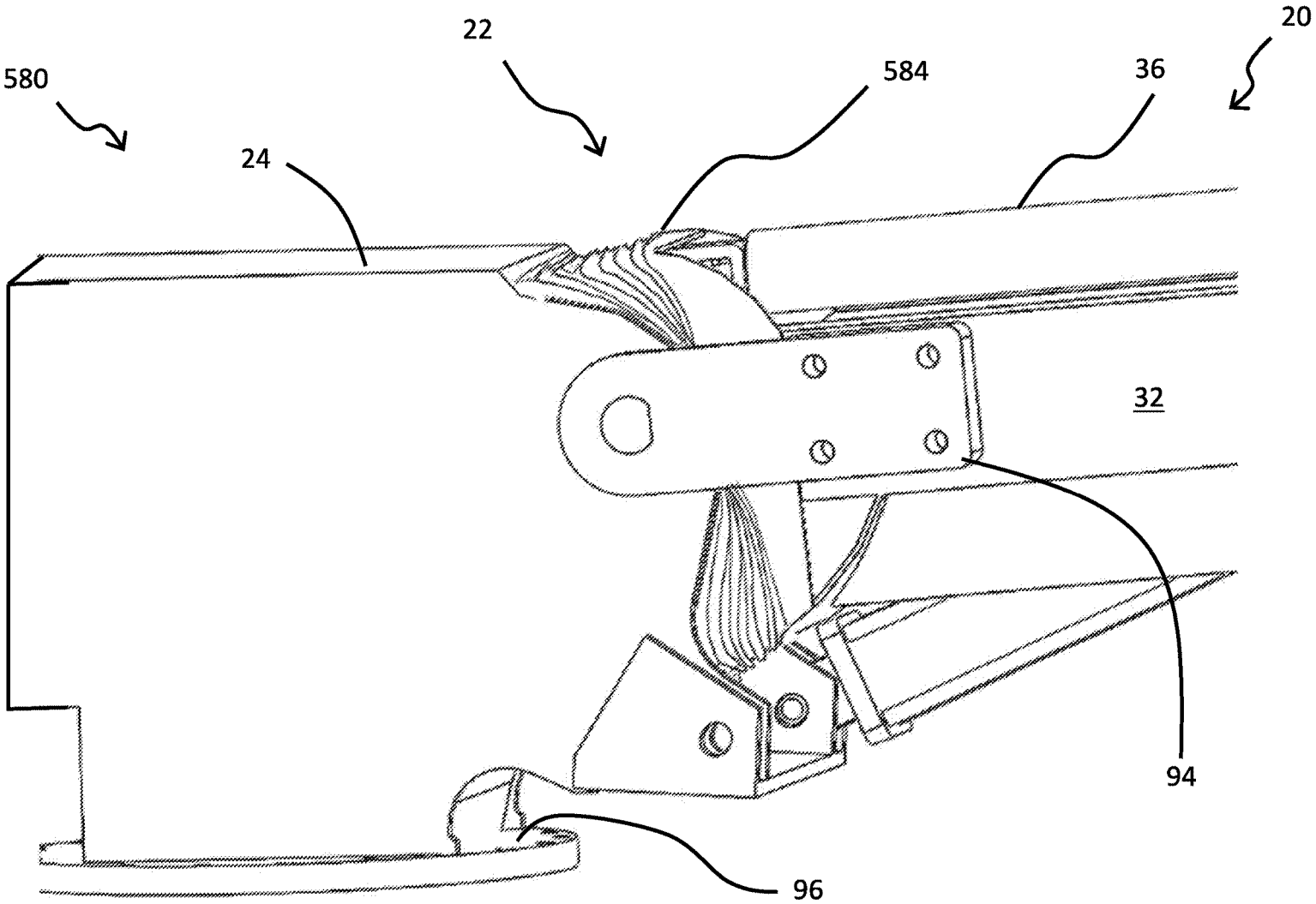
FIG. 30 is a perspective view of another embodiment of a mounting system for a boom assembly.

FIG. 30 shows another exemplary embodiment of a mounting system 580. As shown therein, in some embodiments, the knuckle joint 22 may be sealed using a flexible barrier 584. The barrier 584 may, for example, include a sheet of flexible rubber or neoprene. Alternatively, the barrier 584 may include a heavy-duty polyethylene cloth or tarp. The barrier 584 may, for example, be disposed about the knuckle joint 22 (hidden under the barrier in FIG. 30). In some embodiments, the barrier 584 may be fastened about the knuckle joint 22 mechanically with screws, for example. Alternatively, the barrier 584 may be secured in place using an adhesive or glue. In some embodiments, the barrier 584 may be configured to stretch or flex as the boom assembly 20 rotates up and down in the turret 24. In some embodiments, the barrier 584 may be corrugated. In some embodiments, the barrier 584 may have wire and/or plastic reinforcements as may be useful to help prevent the collapse of the barrier 584 into the joint 22 between the boom assembly 20 and the turret 24.

Figure 31:
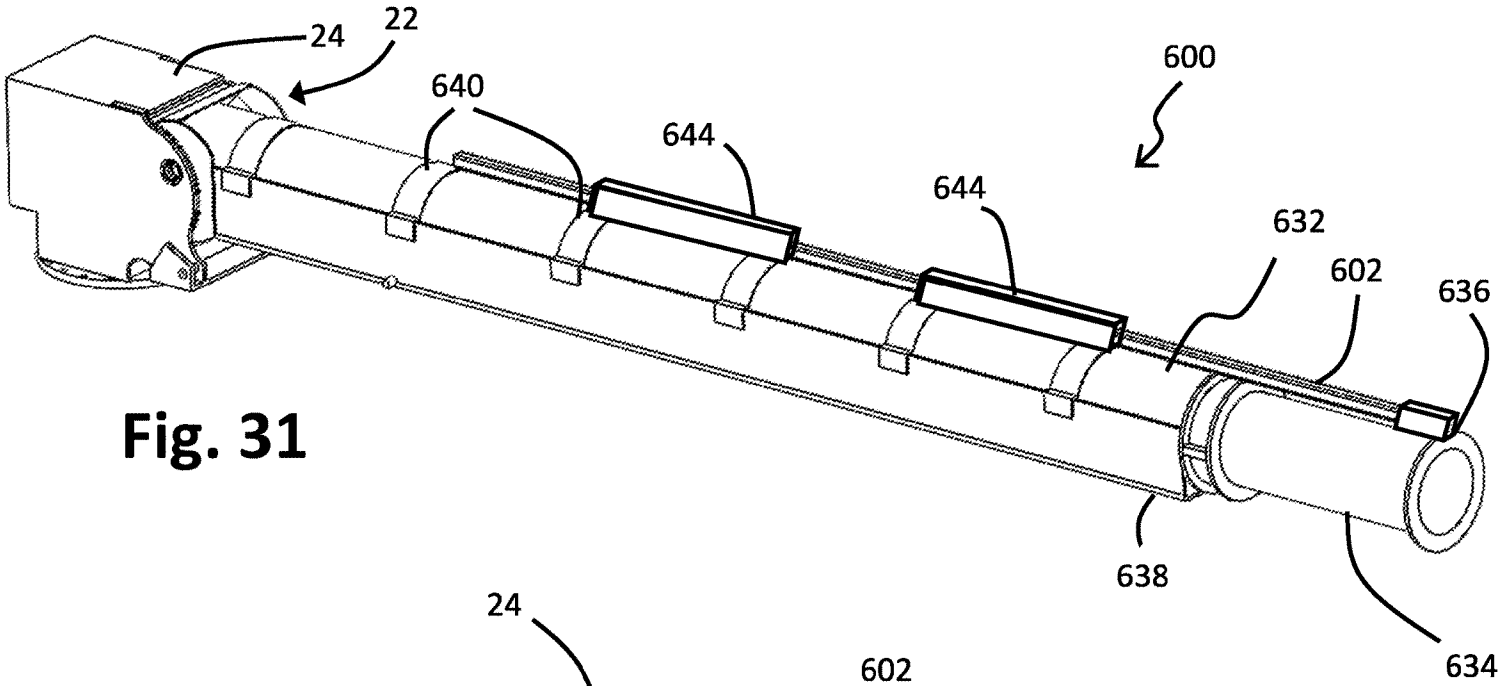
FIG. 31 is a perspective view of an alternative embodiment of a boom assembly and a turret positioned in a partially unnested configuration.
Figure 32:
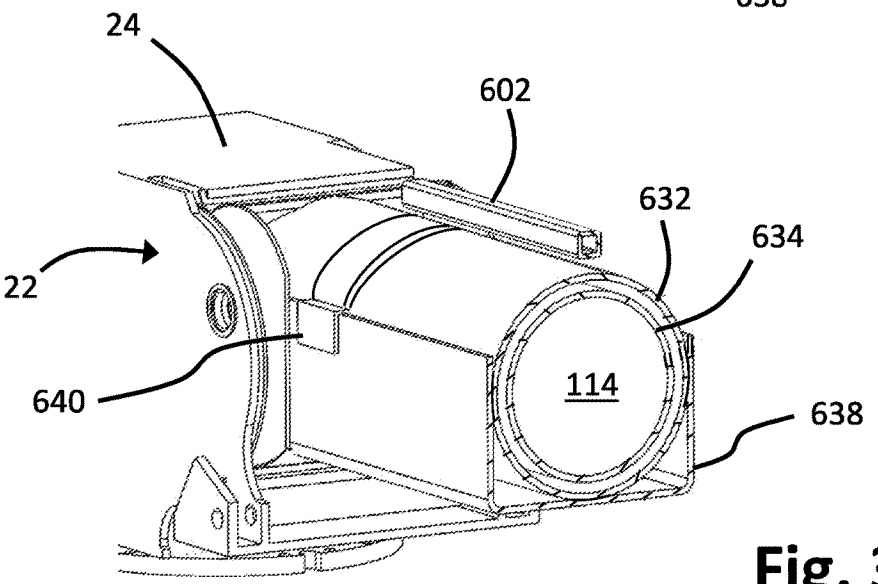
FIG. 32 is a cross-sectional perspective view of a portion of the boom assembly shown in FIG. 31 taken near a proximal end of the boom assembly and with the boom assembly in a fully nested configuration.

FIG. 31 shows a perspective view of another exemplary embodiment of a boom assembly 600 and turret 24. FIG. 32 shows a cross-section of a perspective view of the boom assembly 600 taken at a position near the proximal end of the boom assembly. As shown in FIGS. 31 and 32, in some embodiments, the boom assembly 600 may include one or more anti-rotation or stabilization bars 602, a first boom section 632, a second boom section 634, and a support structure 638. Although a mounting system including the turret 24 and knuckle joint 22 is shown in the illustrated embodiment, the boom assembly 600 may, in other embodiments, be integrated with any other mounting system, turret, or joint as described herein. For example, in some embodiments, the boom assembly 600 may be integrated together with the ball-and-socket joint 522.

In some embodiments, the one or more stabilization bars 602 may connect to the distal end 636 of the second boom section 634. The one or more stabilization bars 602 may further be slidably coupled to the first boom section 632 (e.g., using one or more linear bearings 644). The one or more stabilization bars 602 may be configured to provide strength to the coupling between the first boom section 632 and the second boom section 634 to help prevent rotation of the boom assembly 600 about its longitudinal axis. In some embodiments, the one or more stabilization bars 602 may be configured to move with the second boom section 634 as the second boom section 634 is telescopically extended or retracted. In some embodiments, the one or more stabilization bars 602 may serve as an attachment or connection point wherein the extend and/or retract actuator 36 may be connected to the second boom section 634. For example, a connector (not shown) may connect the one or more of the stabilization bars 602 to both the second boom section 634 and the distal end 40 of the extend and/or retract actuator 36. Thus, extension of the actuator 36 may actuate movement of the one or more stabilization bars 602 along with the second boom section 634 during telescopic extension of the boom assembly 600.

In some embodiments, the first boom section 632 may include a conduit that is sized appropriately so that the second boom section 634 can move therethrough during telescopic extension and/or retraction of the boom assembly 600. The first boom section 632 may include a material with suitable properties (e.g., strength, abrasion resistance, weight, and chemical reactivity) so that it may include an integrated channel 114 therein that is telescopically extendable over a desired length. For example, in some embodiments, material collection channel 114 may be extendable to a maximum channel length ($D_3$) of about 15 feet to about 26 feet. In some embodiments, the first boom section 632 may be made of steel, plastic, or some other suitable material. The first boom section 632 may be welded or mechanically secured to the support structure 638. For example, in some embodiments, the first boom section 632 may be connected to the support structure 638 using one or more connectors 640. The second boom section 634 may be sized so that it may be nested together with the first boom section 632. For example, in some embodiments, the first boom section 632 and the second boom section 634 may be complementary in shape as similarly described in relation the boom assembly 20 shown in FIG. 6, for example. For example, the first boom section 632 may have an upper half pipe 68 with a generally C-section cross-sectional profile and a lower half pipe 70 with a cross-sectional profile in the shape of a segmented arc. The second boom section 634 and the first boom section 632 may be complementary in shape over at least a portion of their cross-sectional profiles so that the second boom section 634 may seat on the first boom section 632. Alternatively, the two boom sections 632, 634 may have a circular cross-sectional profile. Advantageously, this may simplify some embodiments of manufacturing of the boom assembly 600. For example, a combination of boom sections 632, 634 with circular cross-sectional profiles and one or more of the anti-rotation stabilization components (e.g., anti-rotation or stabilization bars 602, wear pads 54, or both) described herein may be used for some boom assemblies 600 of certain size.

In some embodiments, the boom assembly 600 may be used with or without anti-rotation wear pads. For example, in some embodiments, boom assembly 600 may include one or more anti-rotation or stabilization bars 602 and one or more wear pads 54. The one or more wear pads may, for example, be attached at the ends of the boom assembly 600 and be configured to minimize wear/friction between the two boom sections 632, 634.

In some embodiments, the support structure 638 may include a steel frame of appropriate strength to support the first boom section 632 and second boom section 634 nested therein. In some embodiments, the support structure 638 may be open at its top (as shown in the illustrated embodiment shown in FIG. 31) or open to the bottom. This may, for example, allow the first boom section 632 and second boom section 634 to be easily placed therein and/or removed during manufacturing and/or during maintenance or repair. In some embodiments, the support structure 638 may be configured to directly connect to a joint housing 44, 526 and or bearing support. For example, in some embodiments, the joint housings 44, 526 may be connected (e.g., via one or more pins, brackets, weldments, or other connections) to either of the first boom sections 32, 632 or to the support structure 638.

In some embodiments, referring to FIGS. 6 and 23, the first boom section 32, 332 may be constructed with a C-section upper half pipe 68 and a segmented arc lower half pipe 70. In some embodiments, the first boom section 32, 332 may be made of an abrasion-resistant steel (e.g., Brinell hardness 400) that may not be readily available in tube form and may have a yield point that is too high to successfully roll. In some embodiments, the first boom section 32, 332 of the boom assembly 20, 300 may be made using a method that includes shaping the upper half pipe 68, shaping the lower half pipe 70, and then welding the two shaped half pipe sections together. In some embodiments, the upper half pipe 68 and lower half pipe 70 sections of the boom assembly 20, 300 may be made with aligning holes 75 formed along edges of the two half pipes 68, 70 where the two half pipes 68, 70 will be joined (e.g., by welding). The aligning holes may accommodate rods with spacers to help in a welding fixture to maintain proper width between the two half pipes 68, 70 during welding. After the two half pipes 68, 70 are secured together, the rods and spacers may be removed, and the holes may then be plug-welded.

Figure 33:
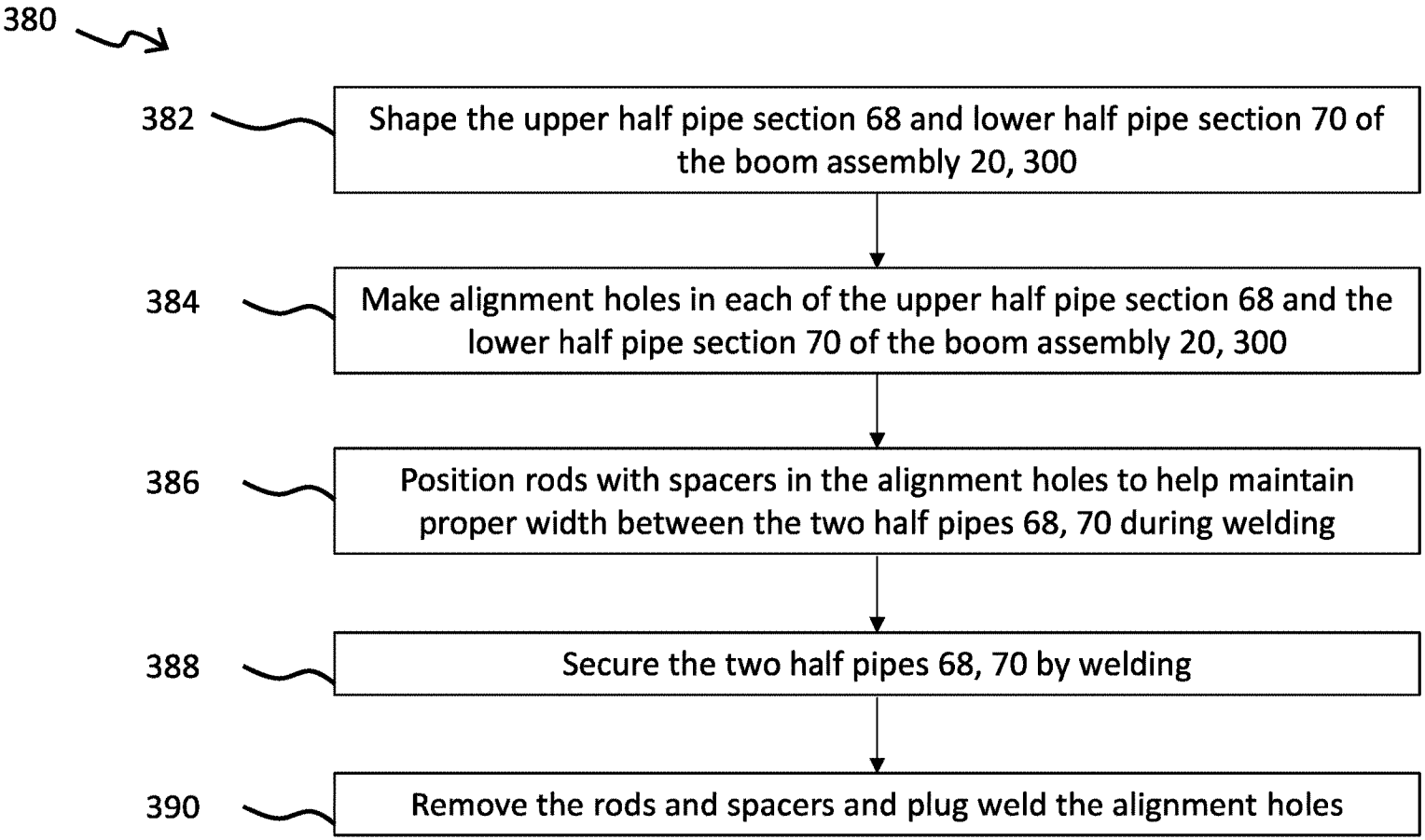
FIG. 33 is a flowchart of an embodiment of a process for making a boom section.

For example, in FIG. 33 an embodiment of a method 380 for making the first boom section 32 is shown. In step 382 the upper half pipe 68 and lower half pipe 70 sections of the boom assembly 20, 300 may be shaped. In step 384 alignment holes may be made in each of the upper half pipe 68 and the lower half pipe 70 sections. In step 386, rods with spacers may be placed in the alignment holes to help maintain proper width between the two half pipes 68, 70 during welding. In step 388, the two half pipes 68, 70 may be welded together. In step 390, the rods and spacers may be removed, and the holes may then be plug-welded.

In some embodiments, the boom assembly 20, 300 may be made of a material with suitable properties (e.g., strength, abrasion resistance, weight, and chemical reactivity) and configured so that it may include an integrated channel 114 that is telescopically extendable over length. For example, boom assembly 20, 300 may include an integrated channel 114 which may be telescopically extendable in length and be of suitable strength so that it may support its own weight and the weight of material collected during its operation when in a cantilevered position. In some of those embodiments, the boom assembly 20, 300 may be telescopically extendable to a maximum extension length of about 5 feet to about 12 feet in length without requiring external brackets or support members extending between the two boom sections 32, 34. An integrated channel 114 may be extended so that the length (D3) of the channel 114 may be up to about 15 feet to about 26 feet in length. In some of those embodiments, the boom assembly 20 may be configured so that telescopic extension of the boom assembly 20 may be driven by a single extension and/or retraction actuator 36. However, in other embodiments, one or more external brackets or support members may be used to add support between the two boom sections 32, 34 of the boom assembly 20, 300.

As described herein, in some embodiments, collected fluid material may sealingly pass directly through boom sections 32, 34 without requiring any flexible hosing or tubing received therein. Still, in some embodiments, the boom sections 32, 34 may receive one or more hoses or tubes therein. For example, flexibly extendable tubing may be received and secured to one or more of the boom sections 32, 34 using one or more mounts or brackets. In such embodiments, the boom sections 32, 34 may, for example, provide stability to any hoses or tubes received therein. Advantageously, this may, for example, help to keep such hoses or tubes from sagging due to pooled collected fluid material. Moreover, rigid boom sections 32, 34 may help to maintain a straight-line path for fluid material thereby helping to reduce abrasion on the boom sections resulting from impinging particulate and fluid matter. In some of those embodiments, material may still pass directly from the boom assembly 20 to the turret 24 without any intermediate hosing or tubing coupled therebetween. Thus, different embodiments herein may provide more or less of a cost savings in terms of maintenance of hosing or tubing depending upon other concerns and factors.

In some embodiments, a single extension and/or retraction actuator 36 may be mounted on top of the boom assembly 20. However, in other embodiments, a plurality of different actuators may be used for telescopic extension of the boom assembly 20. For example, in some embodiments, a pair of extension and/or retraction actuators may be coupled to the boom assembly 20. For example, the pair of actuators may be mounted on the sides of the boom assembly 20 using brackets or mounts as necessary.

Although the foregoing specific details describe certain embodiments of this invention, persons of ordinary skill in the art will recognize that various changes may be made in the details of this invention without departing from the spirit and scope of the invention as defined in the appended claims and other claims that may be drawn to this invention and considering the doctrine of equivalents. Among other things, any feature described for one embodiment may be used in any other embodiment, and any feature described herein may be used independently or in combination with other features. Also, unless the context indicates otherwise, it should be understood that when a component is described herein as being mounted or connected to another component, such mounting or connection may be direct with no intermediate components or indirect with one or more intermediate components. Therefore, it should be understood that this invention is not to be limited to the specific details shown and described herein.

What is claimed is:

1. A material collection vehicle comprising:

a telescopically extendable boom assembly including:

a first boom section and a second boom section;

a bearing seal coupling said first boom section and said second boom section;

wherein said first boom section and said second boom section are sealingly coupled together by said bearing seal to provide a sealing engagement between said first boom section and said second boom section and to allow for telescopic extension of said second boom section with respect to said first boom section while maintaining the sealing engagement between said first boom section and said second boom section; and a mounting system configured for connecting said boom assembly to said material collection vehicle, the mounting system including:

a turret including a turret housing; and a knuckle joint including a knuckle joint housing, the knuckle joint being sealingly coupled to said turret.

2. The material collection vehicle of claim 1, the knuckle joint being sealingly coupled to said turret using one or more seal packings, the one or more seal packings forming a seal along a boundary between said knuckle joint and said turret; and wherein the seal maintains sealing engagement between the turret and the knuckle joint over a range of motion of the knuckle joint.

3. The material collection vehicle of claim 2, the knuckle joint housing including a curved surface upon which at least one of said one or more seal packings is slidably engaged when said knuckle joint and said turret are sealingly coupled together.

4. The material collection vehicle of claim 3 wherein said curved surface is formed on a generally C-shaped bracket including a curved upper surface and a curved lower surface, a top side of said seal being slidably engaged with said upper surface and a bottom side of said seal being slidably engaged with said lower surface.

5. The material collection vehicle of claim 4 wherein said generally C-shaped bracket includes a middle portion that is shaped to form an opening providing for fluid communication through the knuckle joint housing to the turret.

6. The material collection vehicle of claim 1 wherein said first boom section is comprised of an upper half pipe with a C-shaped cross-sectional profile and a lower half pipe with a cross-sectional profile in the form of a segmented arc.

7. The material collection vehicle of claim 1, wherein said first boom section is comprised of an upper half pipe and a lower half pipe;

wherein said second boom section includes a first cross-sectional profile that is complementary in shape to a cross-sectional profile for the lower half pipe of said first boom section.

8. The material collection vehicle of claim 1, further comprising:

a single actuator configured for powering telescopic extension of said boom assembly, said actuator being mounted on top of said first boom section;

wherein said second boom section is shaped to seat within the first boom section in a position that inhibits rotational movement between the first boom section and the second boom section.

9. The material collection vehicle of claim 1 wherein the turret, the knuckle joint, the first boom section, and the second boom section include a sealed fluid path therethrough.

10. The material collection vehicle of claim 1 further comprising:

an actuator configured for powering telescopic extension of said boom assembly;

a proximal end of said actuator being at least partially enclosed by said knuckle joint housing.

11. The material collection vehicle of claim 1, said bearing seal comprising:

a bearing; and one or more bearing clamps configured for securing said bearing against the second boom section to provide for sealing engagement between the bearing and said second boom section.

12. The material collection vehicle of claim 11 wherein the one or more bearing clamps provide for sealing engagement with the first boom section;

wherein the bearing comprises a plurality of pieces of a deformable material wrapped about the second boom section, the plurality of pieces being positioned about the second boom section to form one or more gaps in an absence of pressure provided by the one or more bearing clamps, the plurality of pieces configured to deform to fill in the one or more gaps when said one or more bearing clamps are tightened around the bearing.

13. A mounting system configured for mounting a boom assembly to a material collection vehicle comprising:

a turret including a turret housing enclosing a turret chamber; and a joint including a joint housing shaped to form an opening providing for fluid communication along a fluid pathway including said turret chamber, the joint housing being pinned to the turret housing, the joint being sealingly coupled to said turret using one or more seal packings, the one or more seal packings forming a seal along a boundary between said joint and said turret;

wherein the seal maintains sealing engagement between the turret and the joint over a range of motion of the joint;

wherein said joint comprises a knuckle joint; and wherein the joint housing comprises a curved surface upon which at least one of said one or more seal packings is slidably engaged when said joint and said turret are sealingly coupled together.

14. The mounting system of claim 13 wherein said curved surface is formed on a generally C-shaped bracket including a curved upper surface and a curved lower surface, a top side of said seal being slidably engaged with said upper surface and a bottom side of said seal being slidably engaged with said lower surface.

15. A material collection vehicle comprising:

a telescopically extendable boom assembly including:

a first boom section and a second boom section, the second boom section being configured for nested engagement with said first boom section;

a mounting system configured for connecting said boom assembly to a body of said material collection vehicle, the mounting system including:

a joint including a joint housing shaped to form an opening disposed along a sealed path of fluid communication extending from an interior portion of said boom assembly to said vehicle body through said joint; and a turret coupled to the joint, the turret including a turret housing; and an actuator connected to the turret housing and the boom assembly;

the joint comprising a knuckle joint and being sealingly coupled to the turret using one or more seal packings, the one or more seal packings forming a seal along a boundary between said joint and said turret;

wherein the seal maintains sealing engagement between the turret and the knuckle joint over a range of motion of the knuckle joint;

wherein at least a portion of said seal is slidably engaged with said joint housing along a curved surface of said joint housing.

16. A mounting system configured for mounting a boom assembly to a material collection vehicle comprising:

a turret including a turret housing enclosing a turret chamber; and a joint including a joint housing shaped to form an opening providing for fluid communication along a fluid pathway including said turret chamber, the joint being sealingly coupled to said turret using one or more seal packings, the one or more seal packings forming a seal along a boundary between said joint and said turret;

wherein the seal maintains sealing engagement between the turret and the joint over a range of motion of the joint;

wherein said joint comprises a knuckle joint;

wherein the joint housing comprises a curved surface upon which at least one of said one or more seal packings is slidably engaged when said joint and said turret are sealingly coupled together.

17. The mounting system of claim 16 wherein said curved surface is formed on a generally C-shaped bracket including a curved upper surface and a curved lower surface, a top side of said seal being slidably engaged with said upper surface and a bottom side of said seal being slidably engaged with said lower surface.

18. A material collection vehicle comprising:

a telescopically extendable boom assembly including:

a first boom section and a second boom section, the second boom section being configured for nested engagement with said first boom section;

a mounting system configured for connecting said boom assembly to a body of said material collection vehicle, the mounting system including:

a joint including a joint housing shaped to form an opening disposed along a sealed path of fluid communication extending from an interior portion of said boom assembly to said vehicle body through said joint;

the joint comprising a knuckle joint and being sealingly coupled to a turret using one or more seal packings, the one or more seal packings forming a seal along a boundary between said joint and said turret;

wherein the seal maintains sealing engagement between the turret and the knuckle joint over a range of motion of the knuckle joint;

wherein at least a portion of said seal is slidably engaged with said joint housing along a curved surface of said joint housing.

* * * * *